US010234090B2

(12) United States Patent
Im et al.

(10) Patent No.: US 10,234,090 B2
(45) Date of Patent: Mar. 19, 2019

(54) LIGHTING DEVICE

(71) Applicant: LG Innotek Co., Ltd., Seoul (KR)

(72) Inventors: Chang Hyuk Im, Seoul (KR); Ji Hwan Jeon, Seoul (KR); Sang Jun Hong, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 52 days.

(21) Appl. No.: 15/306,023

(22) PCT Filed: Dec. 9, 2014

(86) PCT No.: PCT/KR2014/012053

§ 371 (c)(1),
(2) Date: Oct. 21, 2016

(87) PCT Pub. No.: WO2015/163556

PCT Pub. Date: Oct. 29, 2015

(65) Prior Publication Data

US 2017/0045188 A1 Feb. 16, 2017

(30) Foreign Application Priority Data

Apr. 24, 2014 (KR) ..... 10-2014-0049296
Apr. 24, 2014 (KR) ..... 10-2014-0049297
(Continued)

(51) Int. Cl.
*F21V 11/00* (2015.01)
*F21S 8/04* (2006.01)
(Continued)

(52) U.S. Cl.
CPC *F21S 8/04* (2013.01); *F21K 9/64* (2016.08); *F21S 8/026* (2013.01); *F21V 3/02* (2013.01);
(Continued)

(58) Field of Classification Search
CPC ..... F21S 8/026; F21S 8/02; F21S 8/00; F21V 29/763; F21K 9/64
(Continued)

(56) References Cited

U.S. PATENT DOCUMENTS 9,010,956 B1 * 4/2015 Davis ..... F21V 17/06 362/147
2010/0226139 A1 * 9/2010 Lynch ..... F21S 8/02 362/373
(Continued)

FOREIGN PATENT DOCUMENTS

EP 2 461 094 A2 6/2012
JP 2013-48052 A 3/2013
(Continued)

*Primary Examiner* — Anh T Mai
*Assistant Examiner* — Matthew J. Peerce
(74) *Attorney, Agent, or Firm* — Birch, Stewart, Kolasch & Birch, LLP

(57) ABSTRACT

A lighting device may be provided according to the embodiment of the present invention. The lighting device according to the embodiment of the present invention includes: a light source which includes a substrate including a top surface and a bottom surface, a plurality of light emitting devices disposed in a central portion of the bottom surface of the substrate, and an input/output portion disposed in an edge portion of the bottom surface of the substrate and electrically connected to a wire; and a body which is coupled to the substrate of the light source and includes an opening through which light from the plurality of light emitting devices of the light source passes. The body includes an inner surface which defines the opening. The body includes a cover portion which is disposed on the inner surface of the body and covers the input/output portion of the light source and the wire.

19 Claims, 16 Drawing Sheets

(30) Foreign Application Priority Data

Apr. 24, 2014 (KR) ..... 10-2014-0049298
Apr. 24, 2014 (KR) ..... 10-2014-0049299
Apr. 24, 2014 (KR) ..... 10-2014-0049300

(51) Int. Cl.

| | |
|---|---|
| ***F21V 29/00*** | (2015.01) |
| ***F21V 17/00*** | (2006.01) |
| ***F21S 8/02*** | (2006.01) |
| ***F21V 3/02*** | (2006.01) |
| ***F21V 7/00*** | (2006.01) |
| ***F21V 19/00*** | (2006.01) |
| ***F21V 29/76*** | (2015.01) |
| ***F21K 9/64*** | (2016.01) |
| ***F21V 7/04*** | (2006.01) |
| ***F21V 15/015*** | (2006.01) |
| ***F21V 17/16*** | (2006.01) |
| ***F21V 23/00*** | (2015.01) |
| *F21V 21/04* | (2006.01) |
| *F21Y 115/10* | (2016.01) |
| *F21Y 105/18* | (2016.01) |

(52) U.S. Cl.

CPC ..... *F21V 7/0058* (2013.01); *F21V 7/04* (2013.01); *F21V 15/015* (2013.01); *F21V 17/00* (2013.01); *F21V 17/166* (2013.01); *F21V 19/003* (2013.01); *F21V 19/0035* (2013.01); *F21V 23/002* (2013.01); *F21V 23/005* (2013.01); *F21V 29/00* (2013.01); *F21V 29/763* (2015.01); *F21V 21/046* (2013.01); *F21Y 2105/18* (2016.08); *F21Y 2115/10* (2016.08)

(58) Field of Classification Search

USPC ..... 362/235

See application file for complete search history.

(56) References Cited

U.S. PATENT DOCUMENTS

| | | | | |
|---|---|---|---|---|
| 2011/0075422 | A1 | 3/2011 | Van De Ven et al. | |
| 2012/0140442 | A1* | 6/2012 | Woo | F21V 7/04 362/95 |
| 2012/0250324 | A1* | 10/2012 | Kimiya | F21V 19/003 362/249.02 |
| 2012/0257389 | A1* | 10/2012 | Lai | F21S 8/026 362/249.02 |
| 2012/0262928 | A1* | 10/2012 | Matsuda | F21S 8/026 362/373 |
| 2013/0100650 | A1* | 4/2013 | Beregszaszi | F21S 8/026 362/145 |
| 2014/0169004 | A1* | 6/2014 | Nakajima | F21S 8/026 362/373 |
| 2014/0268797 | A1* | 9/2014 | Gabrius | F21V 17/002 362/294 |
| 2015/0103528 | A1* | 4/2015 | Seki | F21V 19/0035 362/296.01 |
| 2016/0312984 | A1* | 10/2016 | Poorter | F21V 19/0055 |

FOREIGN PATENT DOCUMENTS

| | | | |
|---|---|---|---|
| KR | 1020090093490 | A | 9/2009 |
| KR | 10-2012-0061657 | A | 6/2012 |
| KR | 20-0466857 | Y1 | 5/2013 |
| WO | WO 2011/013888 | A1 | 2/2011 |

* cited by examiner

LIGHTING DEVICE

CROSS REFERENCE TO RELATED APPLICATIONS

This application is the National Phase of PCT International Application No. PCT/KR2014/012053, filed on Dec. 9, 2014, which claims priority under 35 U.S.C. 119(a) to Patent Application Nos. 10-2014-0049296, filed in the Republic of Korea on Apr. 24, 2014, 10-2014-0049297, filed in the Republic of Korea on Apr. 24, 2014, 10-2014-0049298, filed in the Republic of Korea on Apr. 24, 2014, 10-2014-0049299, filed in the Republic of Korea on Apr. 24, 2014, 10-2014-0049300, filed in the Republic of Korea on Apr. 24, 2014, all of which are hereby expressly incorporated by reference into the present application.

TECHNICAL FIELD

The present disclosure relates to a lighting device.

BACKGROUND ART

A light emitting diode (LED) is a semiconductor element for converting electric energy into light. As compared with existing light sources such as a fluorescent lamp, an incandescent lamp, etc., the LED has advantages of low power consumption, a semi-permanent span of life, a rapid response speed, safety and an environment-friendliness. Therefore, many researches are devoted to substitution of the existing conventional light sources with the LED. The LED is now being increasingly used as a light source for lighting devices, for example, various lamps used interiorly and exteriorly, a liquid crystal display device, an electric sign and a street lamp and the like.

DISCLOSURE

Technical Problem

An embodiment of the present invention provides a lighting device in which it is difficult for light emitted from a light source to transmit through a plastic-made body.

The embodiment provides the lighting device which is strong to external impact.

The embodiment provides the lighting device capable of improving a heat radiation efficiency.

The embodiment provides the lightweight lighting device.

The embodiment provides the lighting device having a manufacturing cost thereof that can be reduced.

The embodiment provides the lighting device which can ensure durability and reliability.

The embodiment provides the lighting device capable of reducing a shadow caused by a wire connected to the light source.

The embodiment provides the lighting device capable of preventing the wire connected to the light source from moving.

The embodiment provides the lighting device capable of improving an optical efficiency.

The embodiment provides the lighting device which is able to endure a high voltage.

The embodiment provides the lighting device capable of preventing a substrate of the light source from moving and rotating.

The embodiment provides the lighting device which is compatible with various substrates having different sizes.

The embodiment provides the lighting device capable of, when the body is coupled to a cover part, easily identifying where the cover part is coupled.

The embodiment provides the lighting device capable of, when the cover part is coupled to the body, preventing the cover part from moving and rotating.

The embodiment provides the lighting device which does not require a converter for converting direct current into alternating current.

The embodiment provides the lighting device in which an installation position of an elastic member is not deviated and changed.

The embodiment provides the lighting device in which a tensile strength of the elastic member can be reinforced.

The embodiment provides the lighting device in which, even though the cover part and the body are separated from each other, the elastic member is not separated from the cover part.

Technical Solution

One embodiment is a lighting device. The lighting device includes: a light source which includes a substrate including a top surface and a bottom surface, a plurality of light emitting devices disposed in a central portion of the bottom surface of the substrate, and an input/output portion disposed in an edge portion of the bottom surface of the substrate and electrically connected to a wire; and a body which is coupled to the substrate of the light source and includes an opening through which light from the plurality of light emitting devices of the light source passes. The body includes an inner surface which defines the opening. The body includes a cover portion which is disposed on the inner surface of the body and covers the input/output portion of the light source and the wire.

The lighting device may further include a reflector which is disposed below the substrate of the light source and is disposed in the opening of the body. The cover portion may include a support surface which supports the reflector.

The support surface of the cover portion may have a shape corresponding to the shape of the reflector.

The reflector may include an inner surface which reflects the light from the plurality of light emitting devices, and an outer surface which is disposed on the cover portion. The outer surface of the reflector may be curved. The support surface of the cover portion may be curved.

The body may further include a support which is disposed on the inner surface of the body, is disposed on the edge portion of the substrate, and supports the reflector. The support may include a support surface. The support surface of the support may have the same inclined angle as that of the support surface of the cover portion with respect to the bottom surface of the substrate.

The body may include an inner wall including the cover portion and an outer wall surrounding the inner wall.

The body may further include an auxiliary wall connected between the inner wall and the outer wall.

An interval between the inner wall of the body and the outer wall of the body may be 8 to 12 T.

Thicknesses of the inner wall of the body and the outer wall of the body may be 1 to 2 T respectively.

The outer wall of the body may have a guide groove in which the wire is disposed.

A width of the guide groove may be less than the thickness of the wire.

The lighting device may further include a cover part which is disposed on the light source and includes a cover having at least one hole. The body may include a coupling portion which corresponds to the hole of the cover part. The lighting device may further include a coupling means which is inserted into the hole of the cover part and is coupled to the coupling portion of the body. The body may include a guide which protrude toward the opening from the inner surface. The guide of the body may support the bottom surface of the substrate, and the inner surface of the body may guide an outer circumferential surface of the substrate.

Another embodiment is a lighting device. The lighting device includes: a light source which includes a substrate including a top surface and a bottom surface, and includes a plurality of light emitting devices disposed on the bottom surface of the substrate; a cover part which includes a cover disposed on the top surface of the substrate, an extension portion extending from the cover in a first direction, and a coupling portion extending from the extension portion in a second direction; a body which receives the light source and is coupled to the cover part; and an elastic member which is coupled to the coupling portion of the cover part.

The coupling portion of the cover part may include a first hole, a second hole, a first axis part, and a second axis part. The elastic member may include a first torsion spring, a second torsion spring, and a fixing portion connected to the first torsion spring and the second torsion spring. The first torsion spring may include a first spiral portion hung on the first axis part of the coupling portion, one end connected to the fixing portion, and the other end which is coupled to the first hole of the coupling portion. The second torsion spring may include a second spiral portion hung on the second axis part of the coupling portion, one end connected to the fixing portion, and the other end which is coupled to the second hole of the coupling portion.

The other end of the first torsion spring may include a first part which is supported by an outer surface of the coupling portion, and a second part which is inserted into the first hole. An end of the second part may pass through the first hole and is disposed adjacent to the body.

An end of the first axis part and an end of the second axis part may be disposed opposite to each other.

The first direction of the extension portion may be perpendicular to the second direction of the coupling portion.

The cover part may be made of a metallic material and the body may be made of plastic.

Further another embodiment is a lighting device. The lighting device includes: a light source which includes a substrate including a top surface and a bottom surface, and includes a plurality of light emitting devices disposed on the bottom surface of the substrate; a cover part which includes a cover disposed on the top surface of the substrate, an extension portion extending from the cover, and a predetermined space defined by the cover and the extension portion; a first body which is coupled to the light source and is received in the space of the cover part; and an elastic member which is coupled to the cover part. The extension portion of the cover part has an opening in which the elastic member is disposed. The cover part includes a coupling portion which protrudes toward the opening from at least one of a plurality of sides defining the opening. The elastic member is coupled to the coupling portion.

The elastic member may include a spiral portion which is hung on the coupling portion, and a fixing portion which is formed by connecting both ends of the spiral portion.

The coupling portions may extend from two mutually facing sides of the plurality of sides and may be disposed opposite to each other.

The cover of the cover part may have a hole. The first body may include a coupling portion disposed on the outer surface of the first body. A coupling means may be coupled to the hole of the cover and to the coupling portion of the first body. The substrate may have a recess to which the coupling portion is coupled.

Yet another embodiment is a lighting device. The lighting device includes: a light source which includes a substrate including a top surface and a bottom surface, and includes a plurality of light emitting devices disposed on the bottom surface of the substrate; and a body including an inner surface which is coupled to the substrate and defines an opening through which light from the plurality of light emitting devices passes, and a guide which extends toward the opening from the inner surface. The guide of the body is disposed below an edge portion of the substrate of the light source and includes a top surface contacting with the bottom surface of the substrate. The guide of the body includes a first protrusion and a second protrusion which are disposed on the top surface of the guide. The edge portion of the substrate has a recess which is coupled to at least any one of the first protrusion and the second protrusion.

A height of the second protrusion may be greater than a height of the first protrusion.

Heights of the first protrusion and the second protrusion may be the same as each other. The recess of the substrate may have a shape capable of receiving both the first protrusion and the second protrusion.

Still another embodiment is a lighting device. The lighting device includes: a light source which includes a substrate including a top surface and a bottom surface, and includes a plurality of light emitting devices disposed on the bottom surface of the substrate; and a body including an inner surface which is coupled to the substrate and defines an opening through which light from the plurality of light emitting devices passes, and a guide which extends toward the opening from the inner surface. The guide of the body is disposed below an edge portion of the substrate of the light source and includes a top surface contacting with the bottom surface of the substrate. The top surface of the guide includes a first surface and a second surface which are not disposed on the same plane. The second surface is connected to the inner surface of the body and is disposed higher than the first surface. The edge portion of the substrate is disposed on at least any one of the first surface and the second surface.

The top surface of the guide may include a level difference surface disposed between the first surface and the second surface. When the edge portion of the substrate is disposed on the first surface, the level difference surface may guide the substrate.

When the edge portion of the substrate is disposed on the second surface, the inner surface of the body may guide the substrate.

Advantageous Effects

The lighting device according to the embodiment makes it difficult for light emitted from a light source to transmit through a plastic-made body.

The lighting device has an advantage to be strong to external impact.

The lighting device has an advantage to improve a heat radiation efficiency.

The lighting device has an advantage to be lightweight.

The lighting device has an advantage to reduce a manufacturing cost thereof.

The lighting device has an advantage to ensure durability and reliability.

The lighting device has an advantage to reduce a shadow caused by a wire connected to the light source.

The lighting device has an advantage to prevent the wire connected to the light source from moving.

The lighting device has an advantage to improve an optical efficiency.

The lighting device has an advantage to endure a high voltage.

The lighting device has an advantage to prevent a substrate of the light source from moving and rotating.

The lighting device has an advantage to be compatible with various substrates having different sizes.

The lighting device has an advantage to, when the body is coupled to a cover part, easily identify where the cover part is coupled.

The lighting device has an advantage to prevent the cover part from moving and rotating when the cover part is coupled to the body.

The lighting device has an advantage to do not require a converter for converting direct current into alternating current.

The lighting device has an advantage to prevent an installation position of an elastic member from being deviated and changed.

The lighting device has an advantage to reinforce a tensile strength of the elastic member.

The lighting device has an advantage to prevent the elastic member from being separated from the cover part, even though the cover part and the body are separated from each other.

MODE FOR INVENTION

In description of embodiments of the present invention, when it is mentioned that an element is formed "on" or "under" another element, it means that the mention includes a case where two elements are formed directly contacting with each other or are formed such that at least one separate element is interposed (indirectly) between the two elements. The "on" and "under" will be described to include the upward and downward directions based on one element.

Hereinafter, a lighting device according to an embodiment of the present invention will be described with reference to the accompanying drawings.

Figure 1:
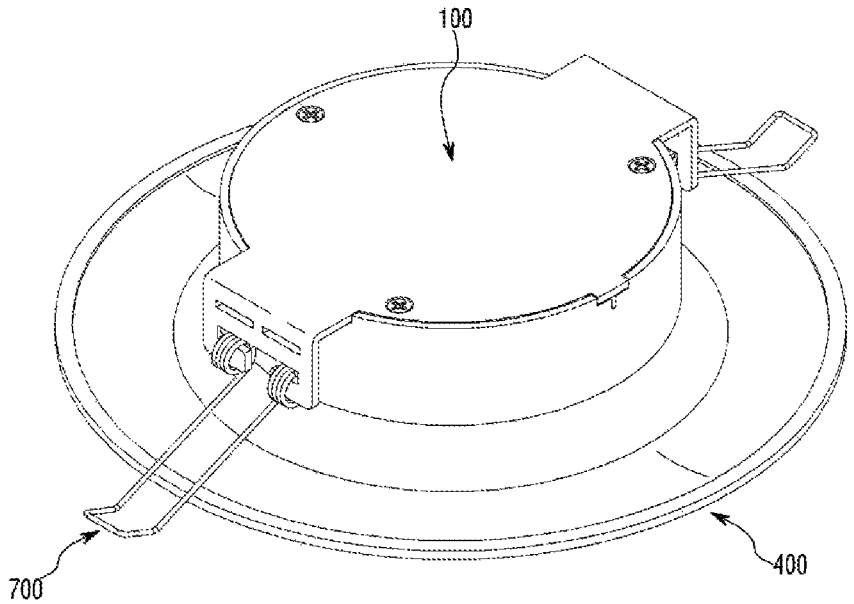
FIG. 1 is a top perspective view of a lighting device according to a first embodiment.
Figure 2:
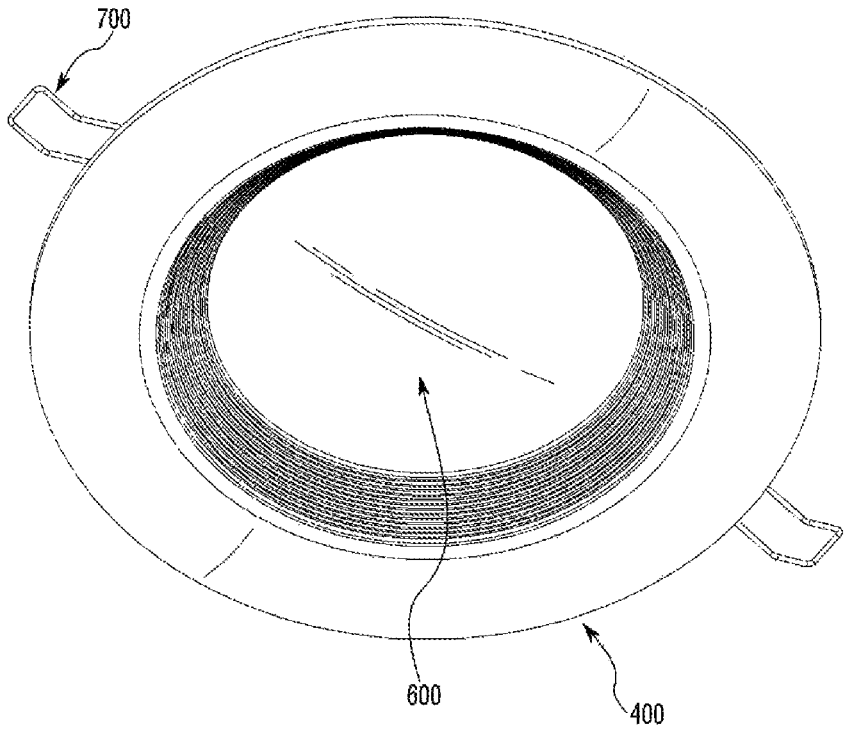
FIG. 2 is a bottom perspective view of the lighting device shown in FIG. 1.
Figure 3:
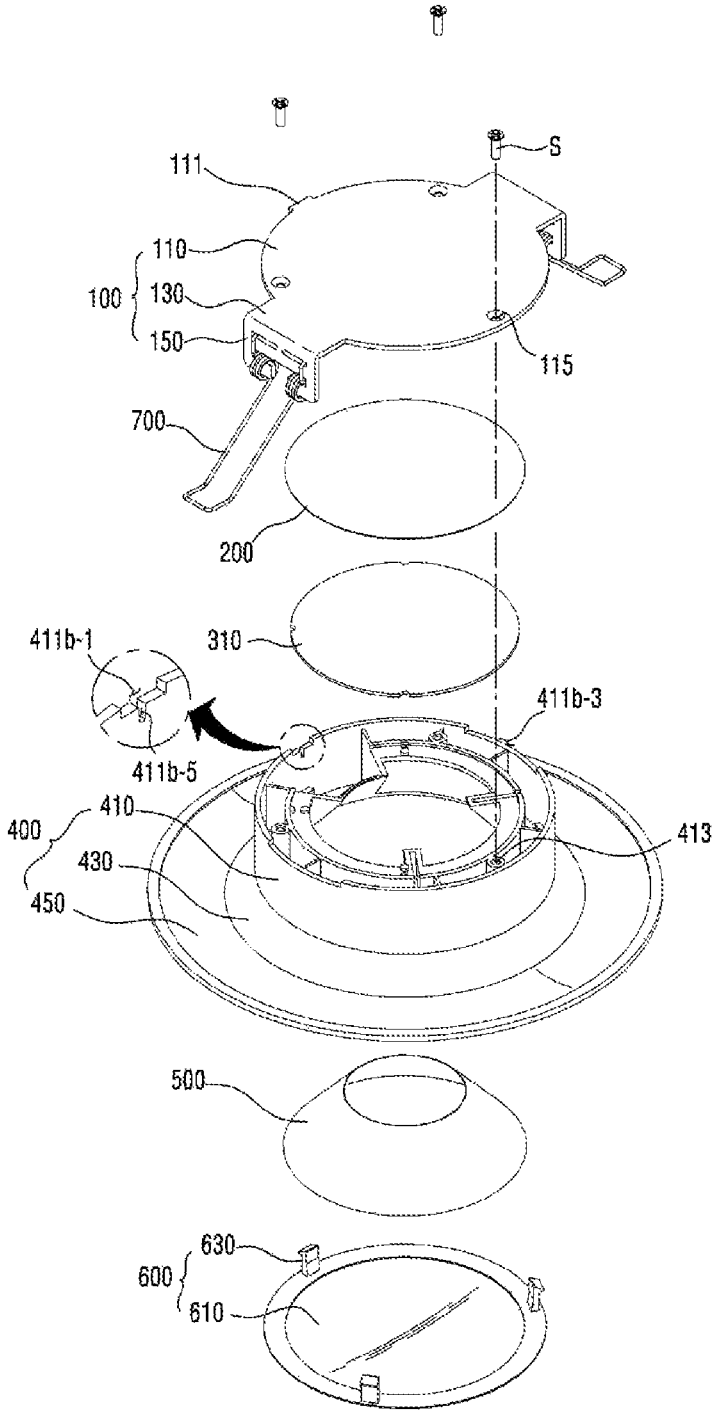
FIG. 3 is an exploded perspective view of the lighting device shown in FIG. 1.
Figure 4:
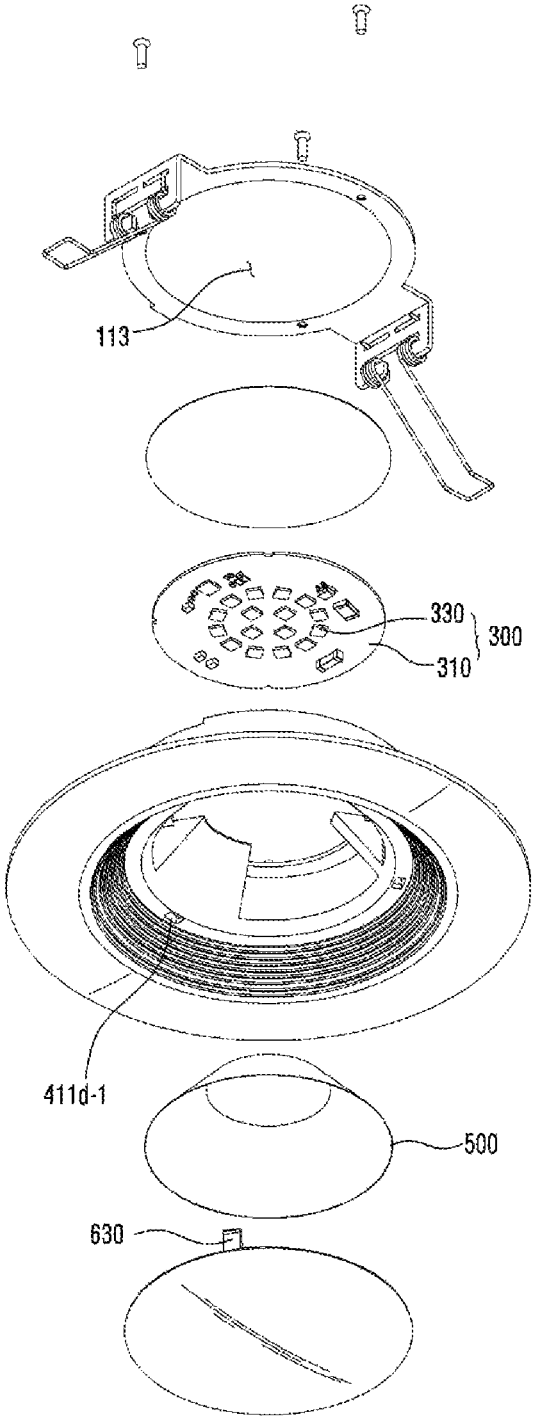
FIG. 4 is an exploded perspective view of the lighting device shown in FIG. 2.
Figure 5:
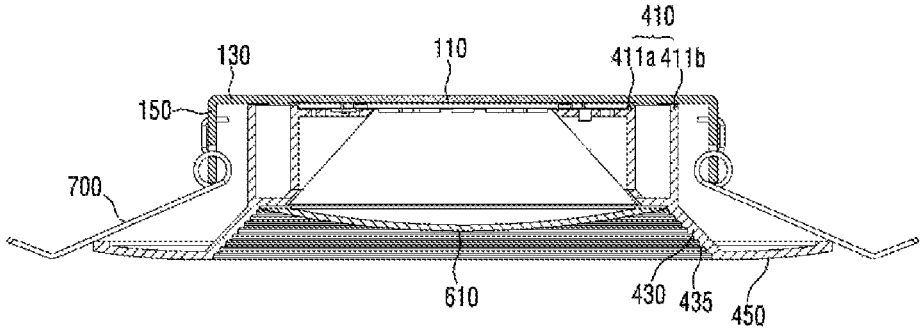
FIG. 5 is a cross sectional views of the lighting device shown in FIG. 1.
Figure 6:
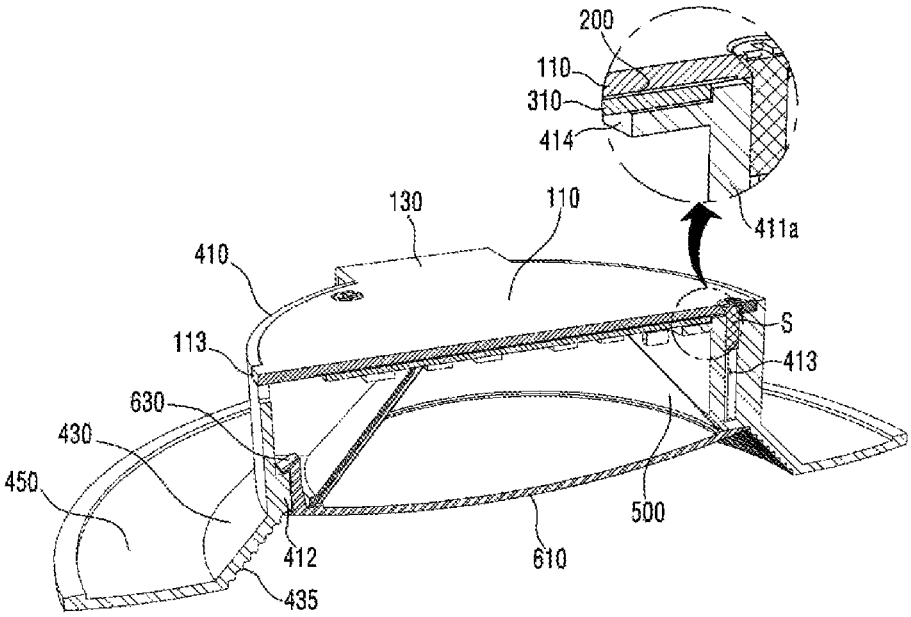
FIG. 6 is a sectional perspective view of the lighting device shown in FIG. 1.

FIG. 1 is a top perspective view of a lighting device according to a first embodiment. FIG. 2 is a bottom perspective view of the lighting device shown in FIG. 1. FIG. 3 is an exploded perspective view of the lighting device shown in FIG. 1. FIG. 4 is an exploded perspective view of the lighting device shown in FIG. 2. FIG. 5 is a cross sectional views of the lighting device shown in FIG. 1. FIG. 6 is a sectional perspective view of the lighting device shown in FIG. 1.

Referring to FIGS. 1 to 6, the lighting device according to the first embodiment may include a cover part 100, a thermally conductive member 200, a light source 300, a body 400, a reflector 500, an optical part 600, and an elastic member 700. Here, while it is described that the lighting device according to the first embodiment includes all of the cover part 100, the thermally conductive member 200, the light source 300, the body 400, the reflector 500, the optical part 600, and the elastic member 700, it should be noted that this is an optimal embodiment. Therefore, a lighting device according to another embodiment different from the first embodiment may be configured to include at least two components among the above-described components.

The cover part 100 is coupled to the body 400. The coupling of the cover part 100 and the body 400 forms the external appearance of the lighting device according to the first embodiment.

The light source 300 is disposed below the cover part 100. The cover part 100 may be made of a heat radiating material capable of receiving heat from the light source 300 and of radiating to the outside. For example, the cover part 100 may be made of a metallic material such as aluminum, aluminum alloy, magnesium, magnesium alloy, etc.

The cover part 100 may include a cover 110, an extension portion 130, and a coupling portion 150. The cover 110, the extension portion 130, and the coupling portion 150 may be integrally formed or may be separately manufactured and connected to each other.

The cover 110 may be disposed on the light source 300 and be coupled to the body 400.

The cover 110 may have a plate shape having a top surface, a bottom surface, and an outer circumferential surface connected between the top surface and the bottom surface. The top surface of the cover 110 may be exposed to the outside. The bottom surface of the cover 110 may directly or indirectly contact with the light source 300.

The cover 110 may include at least one protrusion 111. The protrusion 111 may be extended outwardly from a portion of the outer circumferential surface of the cover 110. One or a plurality of protrusions 111 may be disposed on the outer circumferential surface of the cover 110. The protrusion 111 may have a shape corresponding to the shape of a first guide groove 411*b*-1 of a first body 410. The protrusion 111 may be disposed in the first guide groove 411*b*-1. In a case where the protrusion 111 is disposed in the first guide groove 411*b*-1, when the cover part 100 is coupled to the body 400, the movement and rotation of the cover part 100 can be prevented.

The bottom surface of the cover 110 may include a placement portion 113 on which the thermally conductive member 200 is disposed. The placement portion 113 may be a cavity capable of receiving the thermally conductive member 200.

The cover 110 may have a hole 115 through which coupling means S such as a rivet, a screw or the like pass. The hole 115 may pass through the top surface and bottom surface of the cover 110. The coupling means S is inserted into the hole 115 and then is coupled to a coupling portion 413 of the body 400, so that the cover part 100 and the body 400 may be coupled to each other.

The cover 110 may have, as shown in the drawings, a circular shape. However, the shape of the cover 110 is not limited to this, and the cover 110 may have an elliptical shape or a polygonal shape.

The extension portion 130 may be formed by extending the cover 110 in a first direction. For example, the extension portion 130 may be formed by extending outwardly a portion of the outer circumferential surface of the cover 110. Since the area of the cover part 100 is increased by the extension portion 130, the heat radiation efficiency of the lighting device can be more improved. The first direction may be parallel with the top surface or bottom surface of the cover 110.

The extension portion 130 may be disposed in a second guide groove 411*b*-3 of the first body 410. In a case where the extension portion 130 is disposed in the second guide groove 411*b*-3, when the cover part 100 is coupled to the body 400, the movement and rotation of the cover part 100 can be prevented.

The coupling portion 150 may be formed by extending the extension portion 130 in a second direction. For example, the coupling portion 150 may extend from the end of the extension portion 130 in a direction different from the extension direction of the extension portion 130, and may be coupled to the elastic member 700. The coupling portion 150 may extend from the end of the extension portion 130 in a direction perpendicular to the cover 110 or the extension portion 130. Therefore, the second direction may be perpendicular to the first direction, and the second direction is not limited to this.

Since the area of the cover part 100 is increased by the coupling portion 150, the heat radiation efficiency of the lighting device can be more improved. Also, since the elastic member 700 is coupled to the cover part 100 made of a metallic material having higher strength than that of the plastic-made body 400, the durability and reliability of the lighting device according to the first embodiment can be more obtained.

The light source 300 may be disposed below the cover part 100 and disposed on the body 400. That is, the light source 300 may be disposed between the cover part 100 and the body 400.

The light source 300 can be fixed within the lighting device according to the first embodiment by the coupling of the cover part 100 and the body 400.

The light source 300 may include a substrate 310 and a light emitting device 330.

The substrate 310 may be made by printing a circuit pattern on an insulator. For example, the substrate (not shown) may include a common printed circuit board (PCB), a metal core PCB, a flexible PCB, a ceramic PCB or the like.

One side (top surface) of the substrate 310 may contact with the bottom surface of the cover 110 of the cover part 100 or may contact indirectly with the bottom surface of the cover 110. The case where the top surface of the substrate 310 contacts indirectly with the bottom surface of the cover 110 may include a case where the thermally conductive member 200 is disposed between the substrate 310 and the cover 110.

The other side (bottom surface) of the substrate 310 where the light emitting devices 330 have been disposed may reflect light. For instance, the bottom surface of the substrate 310 may be coated with white, silver, or the like.

One or a plurality of the light emitting devices 330 may be disposed on the bottom surface of the substrate 310.

The light emitting device 330 may be a light emitting diode chip emitting red, green, and blue light or may be a light emitting diode chip emitting ultraviolet light. Here, the light emitting diode may have a lateral type, a vertical type, or a flip chip type and may emit blue, red, yellow or green light.

The light emitting device 330 may include a light emitting structure including a first conductive semiconductor layer, an active layer, and a second conductive semiconductor layer. For example, the light emitting structure may be provided, where the active layer is disposed between the first conductive semiconductor layer and the second conductive semiconductor layer.

The first conductive semiconductor layer may include an n-type semiconductor layer and may be selected from the group consisting of GaN, AlN, AlGaN, InGaN, InN, InAlGaN, AlInN, AlGaAs, GaP, GaAs, GaAsP, AlGaInP, etc. An n-type dopant such as Si, Ge, Sn, Se, Te, etc., may be doped in the first conductive semiconductor layer.

When electrons (or electron holes) which are injected through the first conductive semiconductor layer and electrons (or electron holes) which are injected through the second conductive semiconductor layer meet each other, the active layer emits light due to the band gap difference of an energy band according to the constituent material of the active layer. The active layer may be formed to have any one of a single well structure, a multiple well structure, a quantum dot structure, or a quantum wire structure. The structure of the active layer is not limited to this.

The second conductive semiconductor layer may be implemented by a p-type semiconductor layer and may be selected from the group consisting of GaN, AlN, AlGaN, InGaN, InN, InAlGaN, AlInN, AlGaAs, GaP, GaAs, GaAsP, AlGaInP, etc. A p-type dopant such as Mg, Zn, Ca, Sr, Ba, etc., may be doped in the second conductive semiconductor layer.

Meanwhile, the first conductive semiconductor layer may include the p-type semiconductor layer, and the second conductive semiconductor layer may include the n-type semiconductor layer. Also, a semiconductor layer including the n-type or p-type semiconductor layer may be further disposed below the second conductive semiconductor layer. As a result, the light emitting structure may include at least one of an n-p junction structure, p-n junction structure, n-p-n junction structure, and p-n-p junction structure. The light emitting device 330 may selectively emit light from a visible light range to an ultraviolet range and may emit having a unique color of semiconductor material.

A lens may be disposed on the light emitting device 330. The lens is disposed to cover the light emitting device 330. The lens is able to adjust an orientation angle or direction of the light emitted from the light emitting device 330. The lens may include a light-transmitting resin such as a silicone resin or an epoxy resin. The light-transmitting resin may include a wholly or partially distributed phosphor. The lens may have, for example, a hemispherical cross section or a middle concave portion thereof, etc. The shape of the lens is not limited to this.

When the light emitting device 330 is a blue light emitting diode, the phosphor included in the light-transmitting resin may include at least one of garnet based phosphor (YAG, TAG), silicate based phosphor, nitride based phosphor and oxynitride based phosphor.

It is possible to create natural sunlight (white light) by including yellow phosphor alone to the light-transmitting resin. Additionally, green phosphor or red phosphor may be further included in order to improve a color rendering index and to reduce a color temperature.

When various kinds of phosphors are mixed in the light-transmitting resin, an addition ratio of the color of the phosphor may be formed such that the green phosphor is more used than the red phosphor, and the yellow phosphor is more used than the green phosphor. The garnet phosphor (YAG), the silicate phosphor and the oxynitride phosphor may be used as the yellow phosphor. The silicate phosphor and the oxynitride phosphor may be used as the green phosphor. The nitride phosphor may be used as the red phosphor. The light-transmitting resin may be mixed with various kinds of the phosphors or may be configured by a layer including the red phosphor, a layer including the green phosphor and a layer including the yellow phosphor, which are formed separately from each other.

The light source 300 may be an alternating current (AC) module which can be driven by alternating current. When the light source 300 is an AC module, there is an advantage in that a converter for converting alternating current into direct current is not required inside the lighting device according to the first embodiment.

The light source 300, i.e., the AC module, will be described in more detail with reference to FIGS. 7 to 9.

Figure 7:
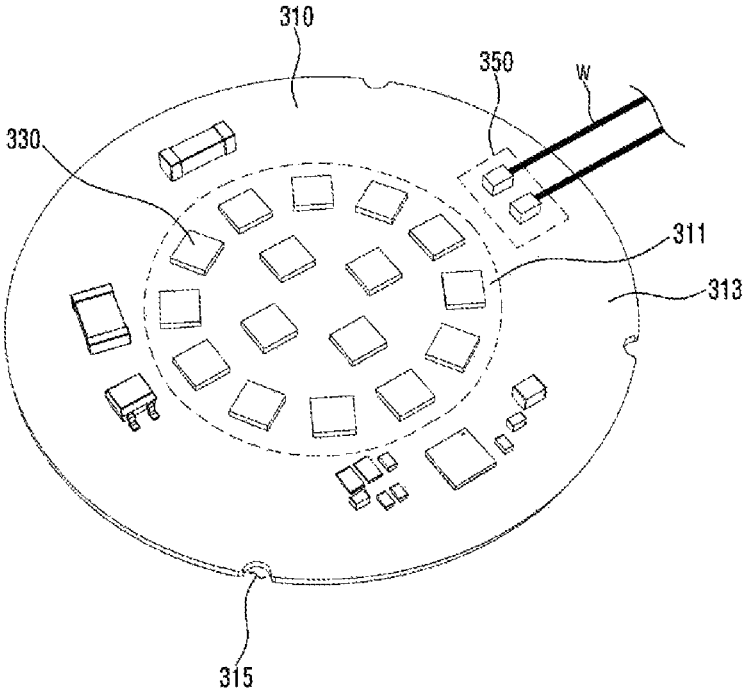
FIG. 7 is a perspective view of a light source 300 shown in FIG. 4.

FIG. 7 is a perspective view of the light source 300 shown in FIG. 4. FIG. 8 is a perspective view of a light source 300' having a size smaller than that of the light source 300 shown in FIG. 7. FIG. 9 is a view showing a circuit pattern of the light source 300' shown in FIG. 8.

Figure 8:
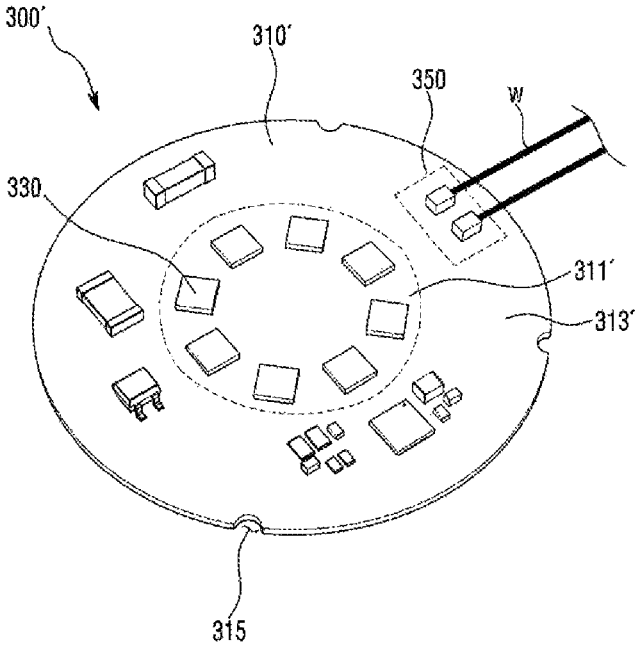
FIG. 8 is a perspective view of a light source 300' having a size smaller than that of the light source 300 shown in FIG. 7.
Figure 9:
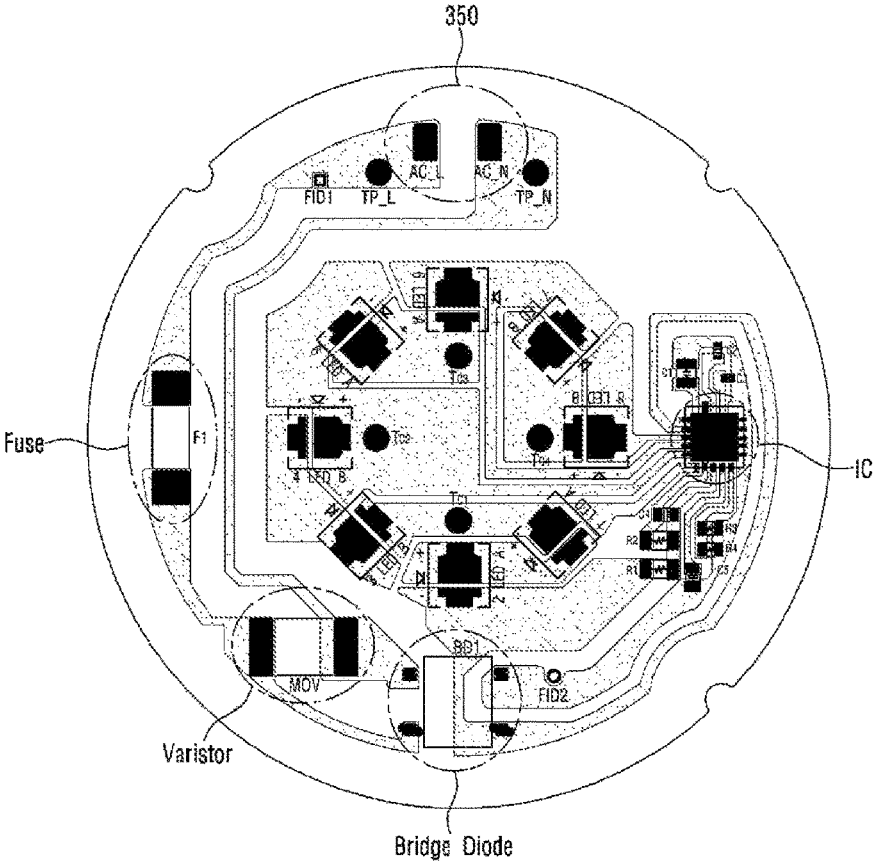
FIG. 9 is a view showing a circuit pattern of the light source 300' shown in FIG. 8.

The size of the substrate 310 of the light source 300 shown in FIG. 7 is larger than that of a substrate 310' of the light source 300' shown in FIG. 8. That is, the diameter of the substrate 310 is larger than that of the substrate 310'. Also, the number of the light emitting devices 330 of the light source 300 shown in FIG. 7 is greater than the number of the light emitting devices 330 of the light source 300' shown in FIG. 8. Therefore, the amount of the light emitted from the light source 300 shown in FIG. 7 is greater than the amount of the light emitted from the light source 300' shown in FIG. 8.

Referring to FIGS. 7 and 8, the substrates 310 and 310' include central portions 311 and 311' and edge portions 313 and 313'. The plurality of light emitting devices 330 may be disposed in the central portions 311 and 311' of the substrates 310 and 310', and an input/output portion 350 may be disposed in the edge portions 313 and 313' of the substrates 310 and 310'. The input/output portion 350 may be electrically connected to a wire "w". Shadow caused by the wire when the input/output portion 350 is disposed in the edge portions 313 and 313' of the substrates 310 and 310' can be less than the shadow caused by the wire when the input/output portion 350 is disposed in the central portions 311 and 311' of the substrates 310 and 310'. When the input/output portion 350 is disposed in the central portions 311 and 311' of the substrates 310 and 310', the wire "w" should be disposed between the two adjacent light emitting devices 330. In this case, a part of the light emitted from the two adjacent light emitting devices 330 is blocked by the wire "w", so that shadow may be generated. However, in the lighting device according to the first embodiment, since the input/output portion 350 is disposed in the edge portions 313 and 313' of the substrates 310 and 310', it is possible to reduce the shadow generation caused by the wire "w".

A fuse, a varistor, a bridge diode, an integrated circuit (IC), a plurality of resistors and a plurality of capacitors may be disposed in the edge portions 313 and 313' of the substrates 310 and 310'.

When the light emitting devices 330 are disposed in the central portions 311 and 311' of the substrates 310 and 310' and other electronic components are disposed in the edge portions 313 and 313', heat which is emitted from the light emitting devices 330 can be rapidly diffused into the edge portions 313 and 313' of the substrates 310 and 310' and heat which is generated from the other electronic components can be rapidly emitted to the outside. As a result, the heat radiation efficiency of the lighting device according to the first embodiment is improved.

The substrates 310 and 310' may have at least one recess 315. The recess 315 may be disposed in the edge portions 313 and 313' of the substrates 310 and 310'. The recess 315 may have a predetermined depth toward the central portions 311 and 311' of the substrates 310 and 310' from the outer circumferential surface of the substrates 310 and 310'.

Referring back to FIGS. 1 to 6, the thermally conductive member 200 may be disposed between the cover part 100 and the light source 300. Specifically, the thermally conductive member 200 may be disposed between the bottom surface of the cover 110 of the cover part 100 and one side of the substrate 310 of the light source 300. Due to the thermally conductive member 200, the substrate 310 and the cover 110 may contact indirectly with each other. The thermally conductive member 200 may rapidly transfer the heat emitted from the light source 300 to the cover part 100. Therefore, the heat radiation efficiency of the lighting device according to the first embodiment can be improved.

Meanwhile, the thermally conductive member 200 is an optional component and it can be considered that the thermally conductive member 200 is not used. In this case, the cover 110 and the substrate 310 may contact directly with each other.

Figure 10:
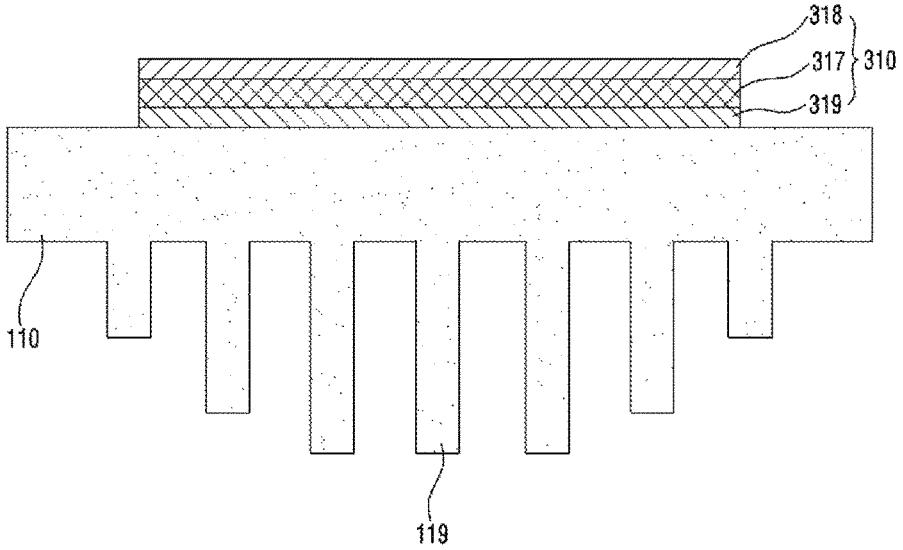
FIG. 10 is a view for describing a method for forming a thermally conductive member 200 and a substrate 310 of the light source 300 shown FIGS. 1 to 6.

FIG. 10 is a view for describing a method for forming the thermally conductive member 200 and the substrate 310 of the light source 300 shown FIGS. 1 to 6.

Referring to FIG. 10, the substrate 310 may include an FR-4 layer 317, a copper foil layer 318, and a bonding layer 319. Through the inclusion of the FR-4 layer 317 in the substrate 310, the isolation performance of the substrate 310 is more enhanced than that of a metal PCB.

The FR-4 layer 317 may include an epoxy resin and glass fiber. The copper foil layer 318 may be disposed on the top surface of the FR-4 layer 317, and the bonding layer 319 may be disposed on the bottom surface of the FR-4 layer 317.

The copper foil layer 318 may be disposed on the FR-4 layer 317 and may be a circuit pattern layer of the substrate 310.

The light emitting device 330 shown in FIG. 4 may be disposed on the top surface of the copper foil layer 318.

The bonding layer 319 is for bonding the cover 110 to the FR-4 layer 317. The top surface of the adhesive layer 319 contacts with the bottom surface of the FR-4 layer 317, and the bottom surface of the adhesive layer 319 contacts with the top surface of the cover 110.

The bonding layer 319 may be made of an acrylic resin.

The bonding layer 319 may have a thickness of from 40 um to 60 um. If the thickness of the bonding layer 319 is larger than 60 um, the bonding layer 319 becomes too thick, so that the heat radiation efficiency is degraded, and if the thickness of the adhesive layer 319 is less than 40 um, the bonding layer 319 becomes too thin, so that an adhesive strength between the cover 110 and the FR-4 layer 317 is reduced, and thus, the cover 110 and the FR-4 layer 317 tend to be separated from each other. Here, it is preferable that the thickness of the bonding layer 319 should be 50 um.

After being disposed between the cover 110 and the FR-4 layer 317, the bonding layer 319 can be more strongly bonded to the cover 110 and the FR-4 layer 317 through a thermal bonding process. Since the bonding layer 319 is more strongly bonded to the cover 110 and the FR-4 layer 317 through the thermal bonding process, the heat radiation efficiency of the lighting device according to the first embodiment can be more improved. Also, when the bonding layer 319 is formed by the thermal bonding, the thickness of the FR-4 layer 317 can be more reduced than when the bonding layer 319 is formed without using the thermal bonding. Therefore, the material amount of the FR-4 constituting the FR-4 layer 317 can be reduced, so that the manufacturing cost thereof is reduced.

In the meantime, the cover 110 may include a plurality of fins 119. The plurality of fins 119 may protrude outward from the outer surface of the cover 110. The plurality of fins 119 increases the surface area of the cover 110, thereby improving the heat radiation efficiency of the lighting device according to the first embodiment. The plurality of fins 119 have a certain length or the length of the fin 119 increases, as shown in the drawing, toward the middle of the cover 110. There is no limit to the length of the fin.

Referring back to FIGS. 1 to 6, the body 400 may be coupled to the cover part 100, the light source 300, and the optical part 600 and may receive the light source 300 and the reflector 500 therewithin.

Unlike the metallic cover part 100, the body 400 may be made of plastic. For example, the body 400 may be made of polycarbonate (PC). The plastic-made body 400 is lighter than when the body 400 is made of a metallic material. Also, the manufacturing cost thereof can be reduced.

The body 400 may include a first body 410, a second body 430, and a third body 450. Here, the first body 410, second body 430, and third body 450 may be integrally formed. However, there is no limit to this. The first body 410, second body 430, and third body 450 may be separately manufactured and coupled to each other.

The first body 410 may be disposed below the light source 300 and may be coupled to the cover part 100 and the light source 300.

The first body 410 may be disposed below the substrate 310 of the light source 300 and may be disposed to surround the plurality of light emitting devices 330 of the light source 300.

The first body 410 may be, as shown in FIG. 6, coupled to the cover 110 of the cover part 100 by coupling means S such as a rivet or a screw. The coupling means S are inserted into the hole 115 of the cover 110 and into the coupling portion 413 of the first body 410 which are shown in FIG. 3, the first body 410 may be coupled to the cover 110. How the first body 410 is coupled to the cover 110 is not limited to this. They may be coupled to each other by means of other structures such as a hook structure, etc.

The first body 410 will be described in detail with reference to FIGS. 11 to 13.

Figure 11:
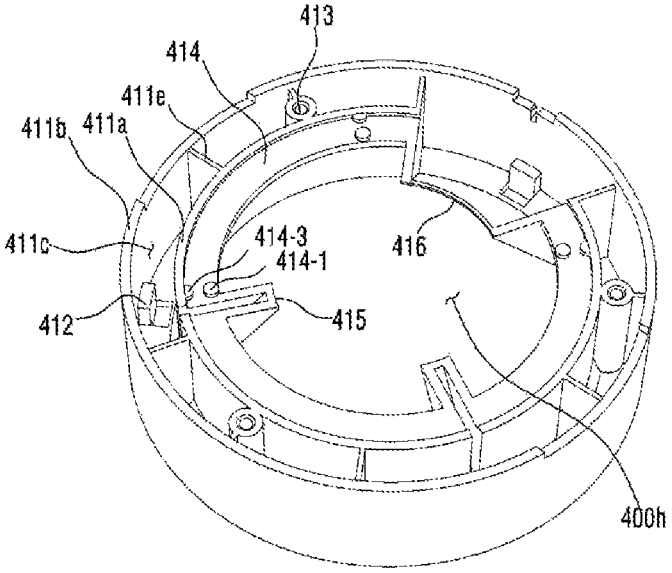
FIG. 11 is a top perspective view of a first body 410 shown in FIG. 3.

FIG. 11 is a top perspective view of the first body 410 shown in FIG. 3. FIG. 12 is a top perspective view of the first body 410 shown in FIG. 11. FIG. 13 is a perspective view showing that the light source 300 and the body 400 shown in FIG. 4 have been coupled to each other.

Figure 12:
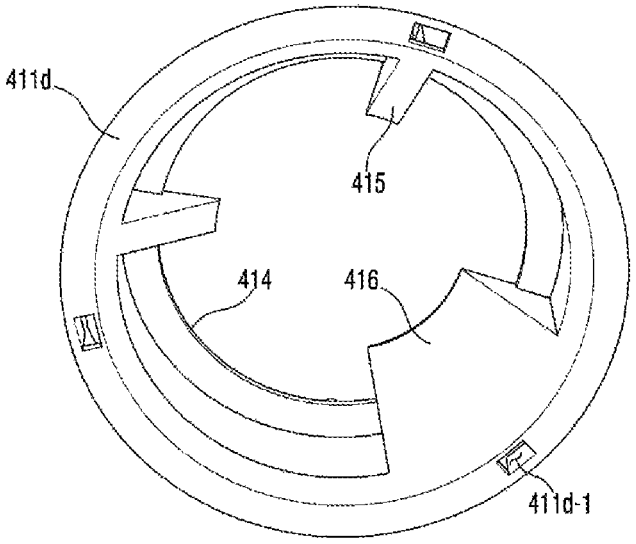
FIG. 12 is a top perspective view of the first body 410 shown in FIG. 11.
Figure 13:
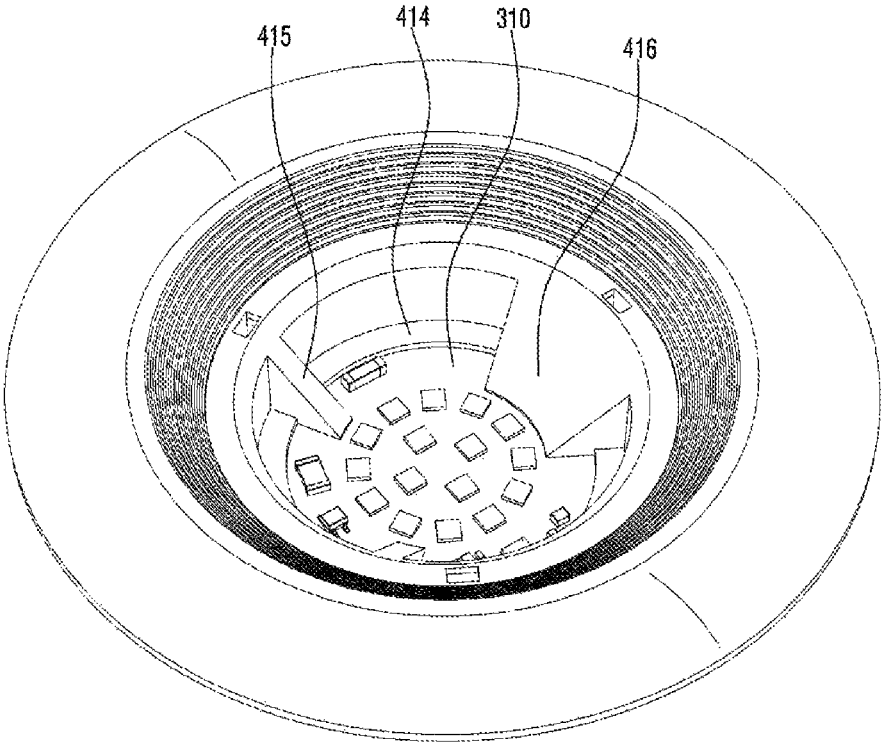
FIG. 13 is a perspective view showing that the light source 300 and the body 400 shown in FIG. 4 have been coupled to each other.

Referring to FIGS. 11 to 13, the first body 410 may have a cylindrical shape. However, the shape of the first body 410 is not limited to this. The first body 410 may have an elliptical tubular shape or a polygonal box shape.

The first body 410 may have, as shown in FIG. 5, a multi-wall structure. Specifically, the first body 410 may include an inner wall 411*a* and an outer wall 411*b*.

The inner wall 411*a* defines an opening 400*h* through which the light emitted from the plurality of light emitting devices 330 passes. The outer wall 411*b* is disposed to surround the inner wall 411*a*. The inner wall 411*a* and the outer wall 411*b* are spaced from each other by a predetermined distance. A predetermined space 411*c* may be formed between the outer wall 411*b* and the inner wall 411*a*. When the plastic-made first body 410 includes the inner wall 411*a* and the outer wall 411*b*, there is an advantage that it is difficult for the light emitted from the light source 300 to pass through the first body 410. Further, the weight of the first body 410 can be less than when the first body 410 has a single-wall structure, so that the manufacturing cost thereof is reduced.

The inner wall 411*a* may include an outer surface facing an inner surface of the outer wall 411*b*, and an inner surface defining the opening 400*h*. The outer wall 411*b* may include the inner surface facing the inner wall 411*a*, and an outer surface exposed to the outside.

The thicknesses of the inner wall 411*a* and the outer wall 411*b* may be 1 to 2 T (mm) respectively. If the thicknesses of the inner wall 411*a* and the outer wall 411*b* are less than 1 T, the light emitted from the light source 300 can easily pass through the inner wall 411*a* and the outer wall 411*b*, and the inner wall 411*a* and the outer wall 411*b* are difficult to process. If the thicknesses of the inner wall 411*a* and the outer wall 411*b* are larger than 2 T, it is difficult to include a space between the inner wall 411*a* and the outer wall 411*b*. It is preferable that the thicknesses of the inner wall 411*a* and the outer wall 411*b* should be 1.5 T respectively.

The interval between the inner wall 411*a* and the outer wall 411*b* may be 8 to 12 T (mm). If the interval between the inner wall 411*a* and the outer wall 411*b* is less than 8 T, the light emitted from the light source 300 may pass through the outer wall 411*b*. If the interval between the inner wall 411*a* and the outer wall 411*b* is greater than 12 T, the strength of the first body 410 is reduced. For example, the interval between the inner wall 411*a* and the outer wall 411*b* may be 10 T.

The inner wall 411*a* and the outer wall 411*b* may be connected to each other. In FIG. 12, a lower portion 411*d* of the first body 410 shown in FIG. 12 may connect the inner wall 411*a* and the outer wall 411*b*. The lower portion 411*d* of the first body 410 connects the inner wall 411*a* and the outer wall 411*b*, thereby stably fixing or supporting the inner wall 411*a* and the outer wall 411*b*. Here, the inner wall 411*a*, the outer wall 411*b*, and the lower portion 411*d* may define the predetermined space 411*c*.

The lower portion 411*d* may have a coupling hole 411*d*-1 in which a connecting portion 630 of the optical part 600 is disposed. The connecting portion 630 is inserted into the coupling hole 411*d*-1, so that the body 400 and the optical part 600 may be coupled to each other.

The outer wall 411*b* may include a catching protrusion 412. The catching protrusion 412 may be disposed on the inner surface of the outer wall 411*b*. The catching protrusion 412 may be coupled to the connecting portion 630 of the optical part 600. A hook disposed on the upper portion of the connecting portion 630 may be caught and fixed by the catching protrusion 412. Here, though not shown in the drawing, the catching protrusion 412 may be also disposed on the outer surface of the inner wall 411*a*.

An auxiliary wall 411*e* may be disposed between the inner wall 411*a* and the outer wall 411*b*. One end of the auxiliary wall 411*e* may be connected to the inner wall 411*a*, and the other end of the auxiliary wall 411*e* may be connected to the outer wall 411*b*. The auxiliary wall 411*e* may constantly maintain the interval between the inner wall 411*a* and the outer wall 411*b* and may protect the first body 410 from external impact.

The coupling portion 413 may be disposed between the inner wall 411*a* and the outer wall 411*b*. The coupling portion 413 may have a recess to which the coupling means S is coupled. One end of the coupling portion 413 may be connected to the inner wall 411*a*, and the other of the coupling portion 413 may be connected to the outer wall 411*b*. The coupling portion 413 may constantly maintain the interval between the inner wall 411*a* and the outer wall 411*b* and may protect the first body 410 from external impact.

The inner wall 411*a* may define the opening 400*h*. For example, the inner surface of the inner wall 411*a* may define the opening 400*h*. Through the opening 400*h*, the light emitted from the light source 300 may be emitted to the outside of the lighting device according to the first embodiment.

The outer wall 411*b* may have, as shown in FIG. 3, the first guide groove 411*b*-1 and the second guide groove 411*b*-3. The first guide groove 411*b*-1 and the second guide groove 411*b*-3 may have different shapes from each other. The first guide groove 411*b*-1 may have a shape corresponding to the protrusion 111, and the second guide groove 411*b*-3 may have a shape corresponding to the extension portion 130. When the first body 410 is coupled to the cover part 100, the first guide groove 411*b*-1 and the second guide groove 411*b*-3 make it possible to easily identify the coupling position of the cover part 100, and thus, provide convenience in the manufacturing process.

The outer wall 411*b* may have, as shown in FIG. 3, a third guide groove 411*b*-5. The third guide groove 411*b*-5 may have a predetermined depth from one side of the outer wall 411*b* defining the first guide groove 411*b*-1.

The wire "w" shown in FIGS. 7 to 8 may be disposed in the third guide groove 411*b*-5. The width of the third guide groove 411*b*-5 may be less than the thickness of the wire "w". If the width of the third guide groove 411*b*-5 is less than the thickness of the wire "w", the wire "w" can be inserted and fixed to the third guide groove 411*b*-5, so that the movement of the wire "w" can be prevented. For example, when the wire "w" includes a conductor wire and a sheath surrounding the conductor wire, the width of the third guide groove 411*b*-5 may be less than the thickness of the wire "w" and may be greater than the conductor wire of the wire "w". In this case, since the sheath of the wire "w" is inserted into the third guide groove 411*b*-5, the movement of the wire "w" can be limited.

The first guide groove 411*b*-1 is disposed on the third guide groove 411*b*-5. Therefore, since the wire "w" is inserted into the third guide groove 411*b*-5 and then the protrusion 111 of the cover 110 disposed in the first guide groove 411*b*-1 stops the third guide groove 411*b*-5, the wire "w" can be stably fixed in the third guide groove 411*b*-5.

The third guide groove 411*b*-5 may correspond to the number of the wires "w". That is, if the plurality of the wires "w" are provided, the plurality of third guide grooves 411*b*-5 may be provided. This will be described with reference to FIG. 14.

Figure 14:
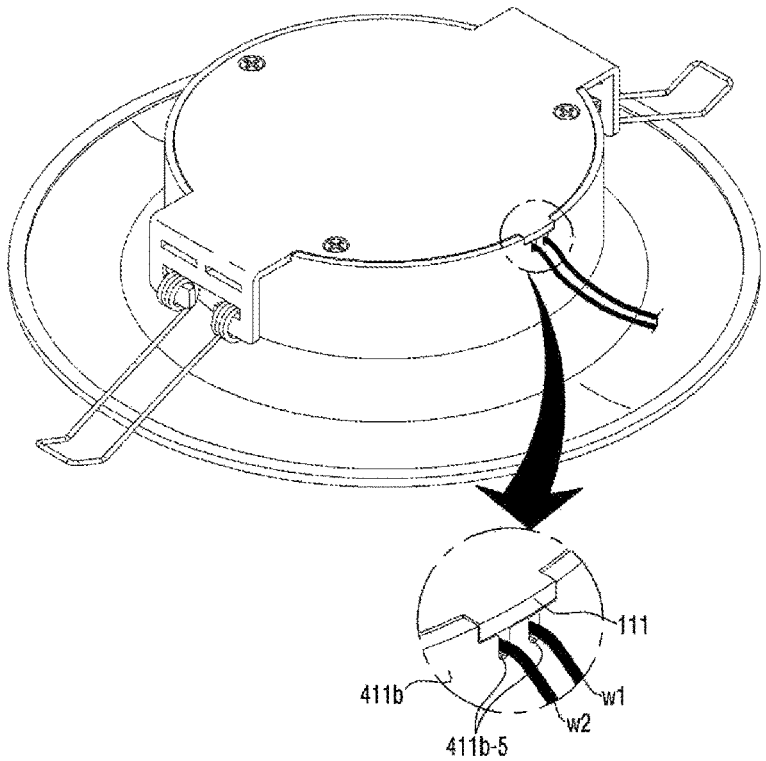
FIG. 14 is a view for describing a case where a plurality of third guide grooves **411*b*-5** are provided.

FIG. 14 is a view for describing a case where the plurality of third guide grooves 411*b*-5 are provided.

Referring to FIG. 14, two third guide grooves 411*b*-5 corresponding to a first wire "w1" and a second wire "w2" respectively are may be disposed on the outer wall 411*b*. Here, the width of the third guide groove 411*b*-5 may be less than the thicknesses of the wires "w1" and "w2". When the width of the third guide groove 411*b*-5 is less than the thicknesses of the wires "w1" and "w2", the movements of the wires "w1" and "w2" can be prevented.

Referring back to FIGS. 11 to 13, the first body 410 may include a guide 414. The guide 414 may extend toward the opening 400*h* from the inner surface of the inner wall 411*a*. Here, the guide 414 may be disposed on the inner surface of the first body composed of a single wall as well as on the inner surface of the first body 410 composed of the double wall.

The guide 414 may be disposed below the edge portion 313 of the substrate 310 shown in FIG. 7. The guide 414 may, as shown in FIGS. 6 and 13, support the substrate 310 such that the substrate 310 does not fall through the opening 400*h*.

The guide 414 may include a top surface and a bottom surface. Here, the top surface of the guide 414 may contact with the bottom surface of the substrate 310.

As shown in FIG. 6, the guide 414 supports the substrate 310, and the coupling means S passes through the hole 115 of the cover 110 shown in FIG. 3 and is coupled to the coupling portion 413. Accordingly, the lighting device according to the first embodiment sufficiently endures a high voltage. Specifically, in a conventional lighting device, the substrate of the light source is directly coupled to a heat sink by means of coupling means such as a screw, etc. As described above, when the substrate is directly coupled to the heat sink by means of a screw, a short-circuit occurs by applying a high voltage to the conventional lighting device, so that the light source is damaged. However, in the lighting device according to the first embodiment, the guide 414 supports the substrate 310, and the inner surface of the inner wall 411*a* protects the side of the substrate 310. Therefore, there is no requirement for a separate coupling means for fixing the substrate 310 to the cover 110. Accordingly, the lighting device according to the first embodiment does not cause the short-circuit even when a high voltage is applied. Specifically, when the substrate 310 is made of a metal PCB, the short-circuit may not occur even at a voltage higher than 4 KV.

The guide 414 of the first body 410 may include protrusions 414-1 and 414-3. The protrusions 414-1 and 414-3 may be disposed on the top surface of the guide 414. The protrusions 414-1 and 414-3 may protrude upward from the top surface of the guide 414. The protrusions 414-1 and 414-3 may be coupled to the recess 315 of the substrates 310 and 310' shown in FIGS. 7 to 8. The protrusions 414-1 and 414-3 are coupled to the recess 315 of the substrates 310 and 310', thereby preventing the movement and rotation of the substrates 310 and 310'.

A plurality of the protrusions 414-1 and 414-3 may be provided and may include the first protrusion 414-1 and the second protrusion 414-3. The first protrusion 414-1 may be disposed farther from the inner wall 411*a* than the second protrusion 414-3. Also, the second protrusion 414-3 may be disposed between the first protrusion 414-1 and the inner wall 411*a*.

Due to the first protrusion 414-1 and the second protrusion 414-3, the lighting device according to the first embodiment is compatible with substrates with various sizes. This will be described in detail with reference to FIGS. 15 to 16.

Figure 15:
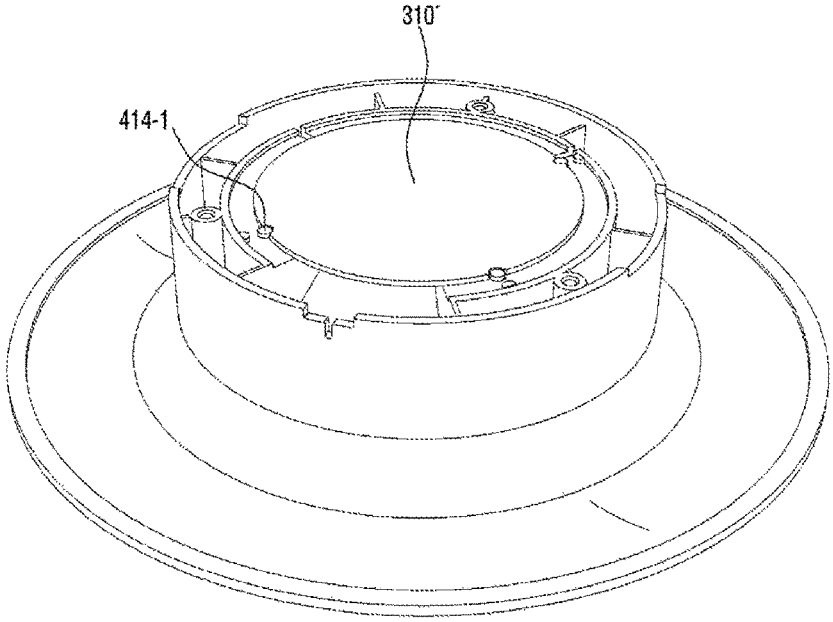
FIG. 15 is a perspective view showing that a substrate 310' shown in FIG. 8 has been coupled to a first protrusion 414-1.
Figure 16:
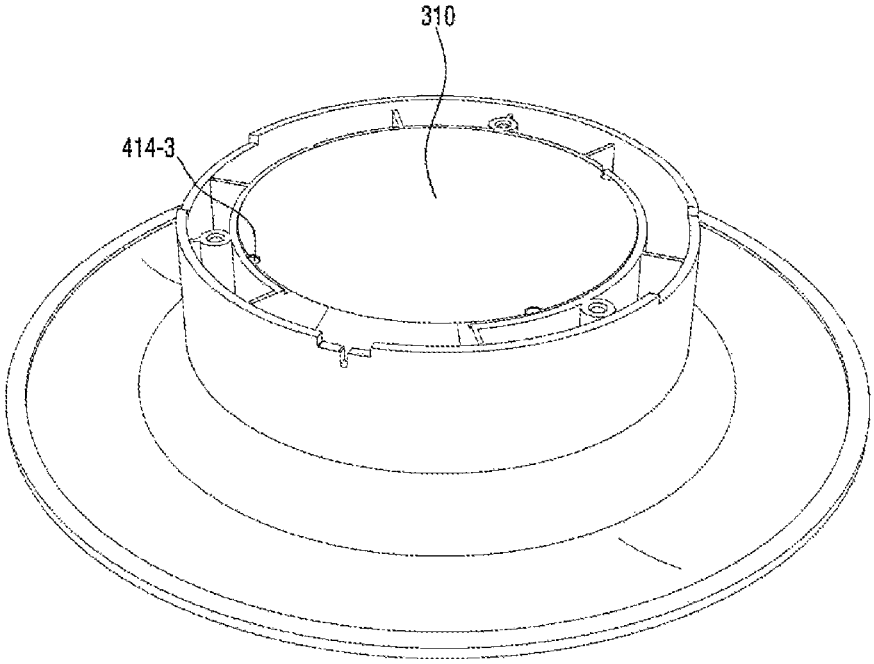
FIG. 16 is a perspective view showing that the substrate 310 shown in FIG. 7 has been coupled to a second protrusion 414-3.

FIG. 15 is a perspective view showing that the substrate 310' shown in FIG. 8 has been coupled to the first protrusion 414-1. FIG. 16 is a perspective view showing that the substrate 310 shown in FIG. 7 has been coupled to the second protrusion 414-3.

Referring to FIG. 15, the first protrusion 414-1 may be disposed in the recess 315 of the substrate 310' shown in FIG. 8. Referring to FIG. 16, the second protrusion 414-3 may be disposed in the recess 315 of the substrate 310 shown in FIG. 7.

Here, the height of the second protrusion 414-3 based on the top surface of the guide 414 may be greater than the height of the first protrusion 414-1. When the height of the second protrusion 414-3 is greater than the height of the first protrusion 414-1, the edge portion of the substrate 310 shown in FIG. 7 may be disposed on the first protrusion 414-1, and the recess 315 of the substrate 310 may be coupled to the second protrusion 414-3.

Meanwhile, the heights of the second protrusion 414-3 and the first protrusion 414-1 may be the same as each other. In this case, the recess 315 of the substrate 310 shown in FIG. 7 may have a shape capable of receiving both the first protrusion 414-1 and the second protrusion 414-3.

The first embodiment-based lighting device including the first protrusion 414-1 and the second protrusion 414-3 may selectively use the substrate 310 shown in FIG. 7 and the substrate 310' shown in FIG. 8, which have different sizes. Therefore, in the lighting device according to the first embodiment, there is no need to manufacture the bodies 400 which correspond in accordance with the light amount of the light source 300 or the substrate of the light source 300 respectively.

Meanwhile, the guide 414 of the first body 410 may selectively use the substrate 310 shown in FIG. 7 and the substrate 310' shown in FIG. 8, which have different sizes, without the inclusion of the first protrusion 414-1 and the second protrusion 414-3. This will be described in detail with reference to FIG. 18.

Figure 18:
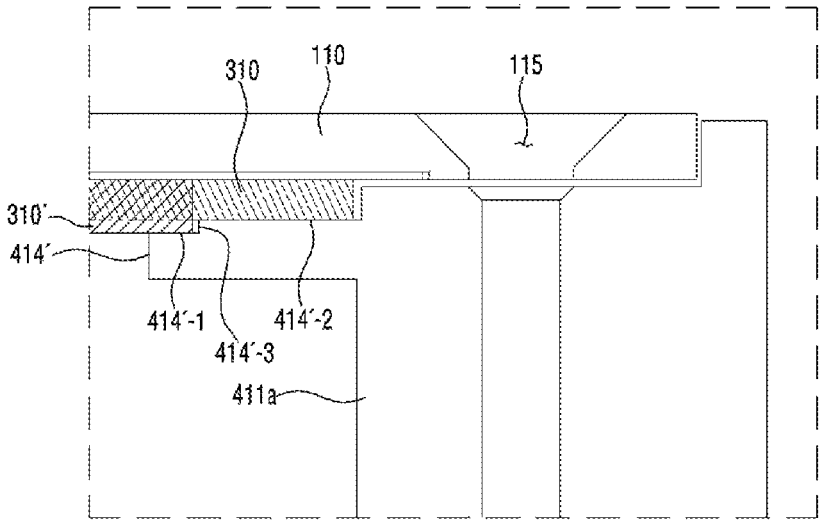
FIG. 18 is a view for describing a modified example of a guide 414 shown in FIG. 11.

FIG. 18 is a view for describing a modified example of the guide 414 shown in FIG. 11.

Referring to FIG. 18, a guide 414' protruding from the inner surface of the inner wall 411*a* may selectively guide the substrate 310 shown in FIG. 7 and the substrate 310' shown in FIG. 8. Here, although it is assumed that the thickness of the substrate 310 shown in FIG. 7 is less than the thickness of the substrate 310' shown in FIG. 8, the thicknesses of the substrates 310 and 310' are not limited to this.

The top surface of the guide 414' may include a first surface 414'-1 supporting the substrate 310' shown in FIG. 8 and a second surface 414'-2 supporting the substrate 310 shown in FIG. 7. The first surface 414'-1 and the second surface 414'-2 may be disposed on different planes without being disposed on the same plane. For example, the second surface 414'-2 may be disposed higher than the first surface 414'-1. Accordingly, a predetermined level difference surface 414'-3 may be disposed between the first surface 414'-1 and the second surface 414'-2.

When the substrate 310' shown in FIG. 8 is disposed on the guide 414', the edge portion of the substrate 310' is disposed on the first surface 414'-1 and the level difference surface 414'-3 guides the substrate 310'. Accordingly, the substrate 310' can be stably fixed on the first body 410.

Meanwhile, when the substrate 310 shown in FIG. 7 is disposed on the guide 414', the edge portion of the substrate 310 is disposed on the second surface 414'-2 and the inner surface of the inner wall 411*a* guides the substrate 310. Accordingly, the substrate 310 can be stably fixed on the first body 410.

As shown in FIG. 18, the guide 414' including the first surface 414'-1, the second surface 414'-2, and the level difference surface 414'-3 may selectively use the substrate 310 shown in FIG. 7 and the substrate 310' shown in FIG. 8, which have different sizes.

In FIG. 18, the side of the substrate 310 and the side of the substrate 310' are spaced apart from the inner surface of the inner wall 411*a* by a predetermined distance. This means a design error which may occur when the lighting device according to the embodiment is actually manufactured. The design error may not occur. That is, the side of the substrate 310 and the side of the substrate 310' may contact with the inner surface of the inner wall 411*a*.

Referring back to FIGS. 11 to 13, the first body 410 may include a support 415. The support 415 may protrude toward the opening 400*h* from the inner surface of the inner wall 411*a*. The support 415 may be disposed on the edge portion of the substrate 310.

Figure 17:
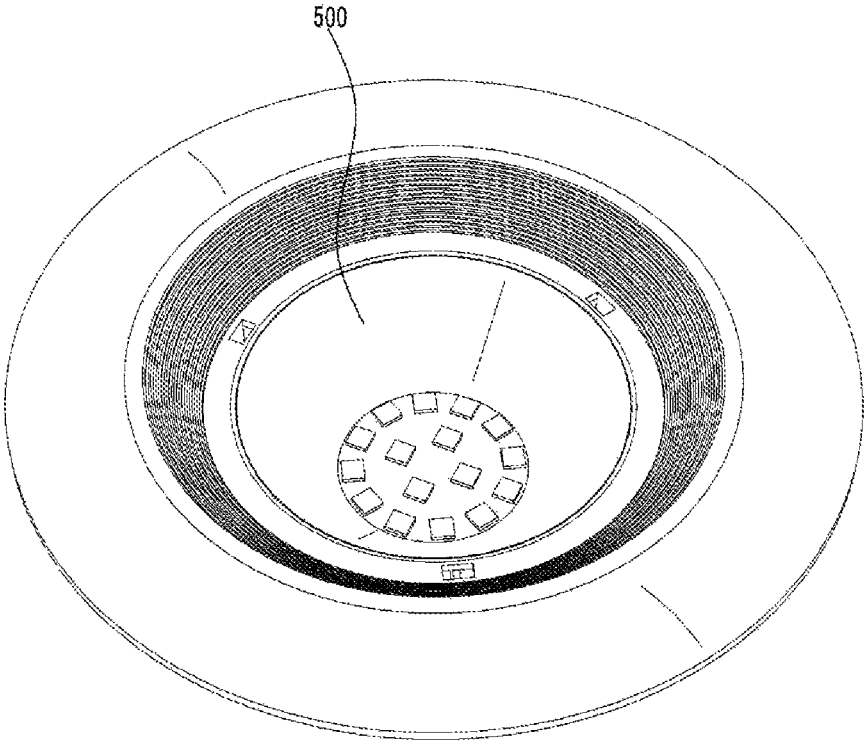
FIG. 17 is a view showing that a reflector 500 has been disposed on a support 415.

The reflector 500 shown in FIGS. 3 to 4 may be disposed on the support 415. FIG. 17 shows that the reflector 500 has been disposed on the support 415.

As shown in FIG. 17, the support 415 may support the reflector 500 on the light source 300. For this, the support 415 may include, as shown in FIGS. 11 to 13, a support surface which supports the reflector 500. The support surface may be inclined to form a predetermined angle with the top surface of the substrate 310. Here, the angle between the support surface and the top surface of the substrate 310 may be an obtuse angle. The inclined angle of the support surface may be in response to the inclined angle of the reflector 500.

Referring back to FIGS. 11 to 13, the first body 410 may include a cover portion 416. The cover portion 416 may protrude toward the opening 400*h* from the inner surface of the inner wall 411*a*. Here, while it is shown in the drawings that the cover portion 416 is disposed on the inner surface of the inner wall 411*a* of the first body 410 composed of the double wall, the cover portion 416 may be disposed on the inner surface of the first body composed of a single wall. In other words, it should be noted that when the first body 410 has a single wall structure including the inner surface and the outer surface, the cover portion 416 may be disposed on the inner surface of the first body 410.

Here, the cover portion 416 may be formed integrally with the inner surface of the inner wall 411*a*. That is, the cover portion 416 may be a portion of the inner surface of the inner wall 411*a*. In this case, the interval between the cover portion 416 and the outer wall 411*b* may not be constant. The interval may be increased toward the upper portion of the cover portion 416 from the lower portion of the cover portion 416.

The cover portion 416 may be disposed on the edge portions 313 and 313' of the light sources 300 and 300' shown in FIGS. 7 to 8.

The cover portion 416 is, as shown in FIG. 13, disposed on the input/output portion 350 of the light sources 300 and 300' shown in FIGS. 7 to 8 and covers the input/output portion 350 and the wire "w". When the light is emitted from the light emitting device 330 of the light source 300, the cover portion 416 is able to prevent the shadow generation caused by the wire "w" connected to the input/output portion 350. That is, if the cover portion 416 is not provided, the shadow may be generated on a diffusion plate 610 of the optical part 600 by the wire "w". However, due to the cover portion 416, the shadow generation can be prevented in advance. Therefore, the lighting device including the cover portion 416 according to the first embodiment can prevent the shadow generation caused by the wire "w" and improve the optical efficiency thereof.

The cover portion 416, together with the support 415, may support the reflector 500. For this, the cover portion 416 may include a support surface supporting the reflector 500.

The support surface may have a shape corresponding to the reflector 500. For example, when the outer surface of the reflector 500 is flat, the support surface may be flat in response to the outer wall. Also, when the outer surface of the reflector 500 is curved, the support surface may be curved in response to the outer wall.

The support surface may be inclined to form a predetermined angle with the top surface of the substrate 310. The support surface of the cover portion 416 may have the same inclined angle as that of the support surface of the support 415 with respect to the bottom surface of the substrate 310. When support surface of the cover portion 416 has the same inclined angle as that of the support surface of the support 415 with respect to the bottom surface of the substrate 310, the reflector 500 can be more stably supported. In particular, when the reflector 500 is made of a paper material, it is possible to prevent the external appearance of the reflector 500 from being damaged by external impact.

Referring back to FIGS. 1 to 6, the second body 430 may be disposed below the first body 410 and may extend from the lower portion 411*d* of the first body 410 shown in FIG. 12.

The second body 430 may have a cylindrical shape.

The second body 430 may extend, as shown in FIG. 5, from the lower portion 411*d* of the first body 410 in such a manner that the diameter of the second body 430 is increased.

The second body 430 may include an outer surface and an inner surface. The outer surface may be exposed to the outside, and the inner surface may include unevenness 435 for the diffusion or scattering of the light emitted from the diffusion plate 610 of the optical part 600.

The third body 450 may be disposed below the second body 430 and may extend from the end of the second body 430.

The third body 450 may be disposed below a ceiling on which the lighting device according to the first embodiment is installed.

The reflector 500 is disposed below the light source 300.

The reflector 500 may be disposed within the body 400. For example, the reflector 500 may be disposed in the opening 400*h* of the body 400.

The reflector 500 may be supported by the support 415 and cover portion 416 of the first body 410 and may be fixed to the inside of the body 400 by the coupling of the optical part 600 and the body 400.

The reflector 500 may include an inner surface and an outer surface. The inner surface reflects the light emitted from the plurality of light emitting devices 330. The outer surface is disposed on the cover portion 416 and the support 415.

The reflector 500 may reflect the light emitted from the light emitting device 330 to the diffusion plate 610 and may again reflect the light returning from the diffusion plate 610 to the diffusion plate 610.

The top of the reflector 500 may be disposed on the top surface of the substrate 310 of the light source 300, and the bottom of the reflector 500 may be disposed on the diffusion plate 610 of the optical part 600.

The reflector 500 may have a cylindrical shape. The diameter of the opening of the top of the reflector 500 may be less than that of the opening of the bottom of the reflector 500. For example, the reflector 500 may have a conical shape.

The reflector 500 may be made of a metallic material capable of reflecting light or may be made of a white paper sheet.

The optical part 600 may be coupled to the body 400 and may be disposed below the reflector 500.

The optical part 600 may include the diffusion plate 610 for reflecting the light incident from the light source 300 and the reflector 500 and may include the connecting portion 630 for the coupling to the body 400.

The diffusion plate 610 may include a diffusing agent in order to diffuse the incident light thereinside. The diffusion plate 610 may have a downwardly convex shape for making it easier to diffuse the incident light.

The connecting portion 630 may protrude upward from the edge portion of the diffusion plate 610. The connecting portion 630 may be coupled to the coupling hole 411*d*-1 of the body 400. The connecting portion 630 may be inserted into the coupling hole 411*d*-1.

The hook may be disposed on the upper portion of the connecting portion 630. The hook of the connecting portion 630 may pass through the coupling hole 411*d*-1 of the body 400, and then may be coupled to the catching protrusion 412 of the body 400. The hook of the connecting portion 630 is caught by the top surface of the catching protrusion 412, so that the optical part 600 and the body 400 can be firmly coupled to each other.

One connecting portion 630 or a plurality of the connecting portions 630 may be provided. The number of the connecting portions 630 may correspond to the number of the coupling holes 411*d*-1 of the body 400.

The elastic member 700 is coupled to the cover part 100. The elastic member 700 may be coupled to the coupling portion 150 of the cover part 100.

The elastic member 700 presses the top surface of the ceiling on which the lighting device according to the first embodiment is installed. That is, the ceiling is disposed between the elastic member 700 and the third body 450 of the body 400. Since an elastic force of the elastic member 700 acts on the third body 450, the lighting device according to the first embodiment can be strongly fixed to the ceiling.

The elastic member 700 will be described in detail with reference to FIG. 19.

Figure 19:
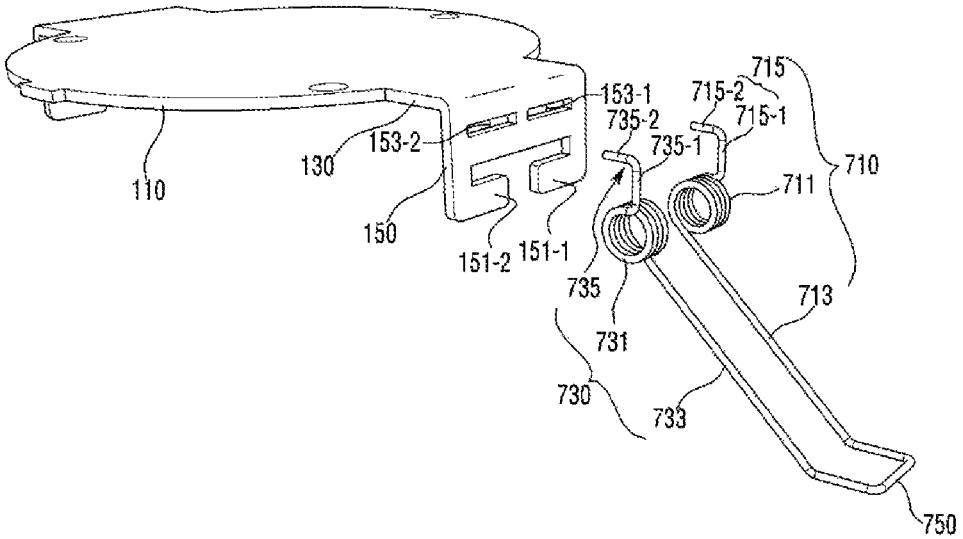
FIG. 19 is an exploded perspective view of a cover part 100 and an elastic member 700 shown in FIG. 3.

FIG. 19 is an exploded perspective view of the cover part 100 and the elastic member 700 shown in FIG. 3.

Referring to FIG. 19, the elastic member 700 may include a first torsion spring 710, a second torsion spring 730, and a fixing portion 750.

The first torsion spring 710 may include a first spiral portion 711, one end 713 of the first spiral portion 711, and the other end 715 of the first spiral portion 711.

The first spiral portion 711 may be formed by rolling up one wire in a spiral direction. The first spiral portion 711 may be hung on a first axis part 151-1 of the coupling portion 150 of the cover part 100.

The one end 713 may be connected to the fixing portion 750. Here, the one end 713 and the fixing portion 750 may be integrally formed with each other.

The other end 715 may include a first part 715-1 and a second part 715-2. The first part 715-1 is connected to the first spiral portion 711 and is disposed on the outer surface of the coupling portion 150. The second part 715-2 extends from the end of the first part 715-1 in a direction different from the longitudinal direction of the first part 715-1 and is coupled to a first hole 153-1 of the coupling portion 150. The length of the second part 715-2 may be greater than the thickness of the coupling portion 150. The end of the second part 715-2 may pass through the first hole 153-1 and may be disposed adjacent to the body 400. Here, the longitudinal direction of the second part 715-2 may be perpendicular to the longitudinal direction of the first part 715-1. The longitudinal direction of the second part 715-2 is not limited to this.

The second torsion spring 730 may include a second spiral portion 731, one end 733 of the second spiral portion 731, and the other end 735 of the second spiral portion 731.

The second spiral portion 731 may be formed by rolling up one wire in a spiral direction. The second spiral portion 731 may be hung on a second axis part 151-2 of the coupling portion 150 of the cover part 100.

The one end 733 may be connected to the fixing portion 750. Here, the one end 733 and the fixing portion 750 may be integrally formed with each other.

The other end 735 may include a first part 735-1 and a second part 735-2. The first part 735-1 is connected to the second spiral portion 731 and is disposed on the outer surface of the coupling portion 150. The second part 735-2 extends from the end of the first part 735-1 in a direction different from the longitudinal direction of the first part 735-1 and is coupled to a second hole 153-2 of the coupling portion 150. The length of the second part 735-2 may be greater than the thickness of the coupling portion 150. The end of the second part 735-2 may pass through the second hole 153-2 and may be disposed adjacent to the body 400. Here, the longitudinal direction of the second part 735-2 may be perpendicular to the longitudinal direction of the first part 735-1. The longitudinal direction of the second part 735-2 is not limited to this.

The fixing portion 750 is disposed between the first torsion spring 710 and the second torsion spring 730. Specifically, one end of the fixing portion 750 may be connected to the one end 713 of the first torsion spring 710, and the other end of the fixing portion 750 may be connected to the one end 733 of the second torsion spring 730.

The fixing portion 750 presses the top surface of the ceiling on which the lighting device according to the first embodiment is installed, so that the lighting device according to the first embodiment can be fixed to the ceiling.

The fixing portion 750 may have a U-shape. However, the shape of the fixing portion 750 is not limited to this. The fixing portion 750 has any shape capable of pressing the ceiling.

Meanwhile, the coupling portion 150 may include the first and second axis parts 151-1 and 151-2, and the first and second holes 153-1 and 153-2.

The first and second holes 153-1 and 153-2 may be disposed above the first and second axis parts 151-1 and 151-2.

The first axis part 151-1 is disposed in the lower portion of the coupling portion 150 and is coupled to the first spiral portion 711 of the first torsion spring 710. Due to the first axis part 151-1, the first spiral portion 711 can be coupled to the coupling portion 150 and can rotate about the first axis part 151-1.

The second axis part 151-2 is disposed in the lower portion of the coupling portion 150 and is coupled to the second spiral portion 731 of the second torsion spring 730. Due to the second axis part 151-2, the second spiral portion 731 can be coupled to the coupling portion 150 and can rotate about the second axis part 151-2.

The end of the first axis part 151-1 and the end of the second axis part 151-2 may be disposed opposite to each other. When the end of the first axis part 151-1 and the end of the second axis part 151-2 are disposed opposite to each other, the first torsion spring 710 and the second torsion spring 730 are hung on the first axis part 151-1 and the second axis part 151-2, and thus are difficult to separate from the axis parts.

The first hole 153-1 may be disposed above the first axis part 151-1, and the second hole 153-2 may be disposed above the second axis part 151-2. The other end 715 of the first torsion spring 710 may be inserted into the first hole 153-1, and the other end 735 of the second torsion spring 730 may be inserted into the second hole 153-2.

The effect of the cover part and elastic member shown in FIG. 19 will be described with reference to FIGS. 20 and 21.

Figure 20:
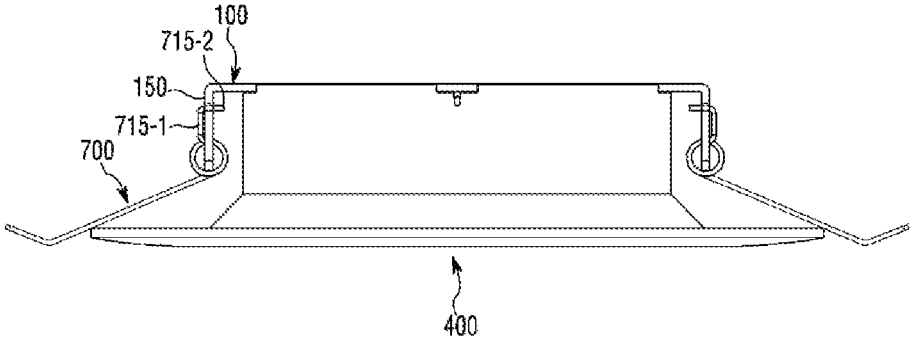
FIG. 20 is a side view of the lighting device shown in FIG. 1.

FIG. 20 is a side view of the lighting device shown in FIG. 1. FIG. 21 is a side view showing that the cover part of the lighting device shown in FIG. 20 is separated from the body.

Referring to FIGS. 19 and 20, the first part 715-1 of the other end 715 of the elastic member 700 is supported by the outer surface of the coupling portion 150 of the cover part 100, and the second part 715-2 is inserted into the first hole 153-1 of the coupling portion 150 of the cover part 100. Accordingly, the tensile strength of the elastic member 700 is reinforced. Even when a very strong tensile strength acts on the elastic member 700, the second part 715-2 of the elastic member 700 is difficult to separate from the first hole 153-1 of the coupling portion 150, so that the installation position of the elastic member 700 is not deviated and changed.

Figure 21:
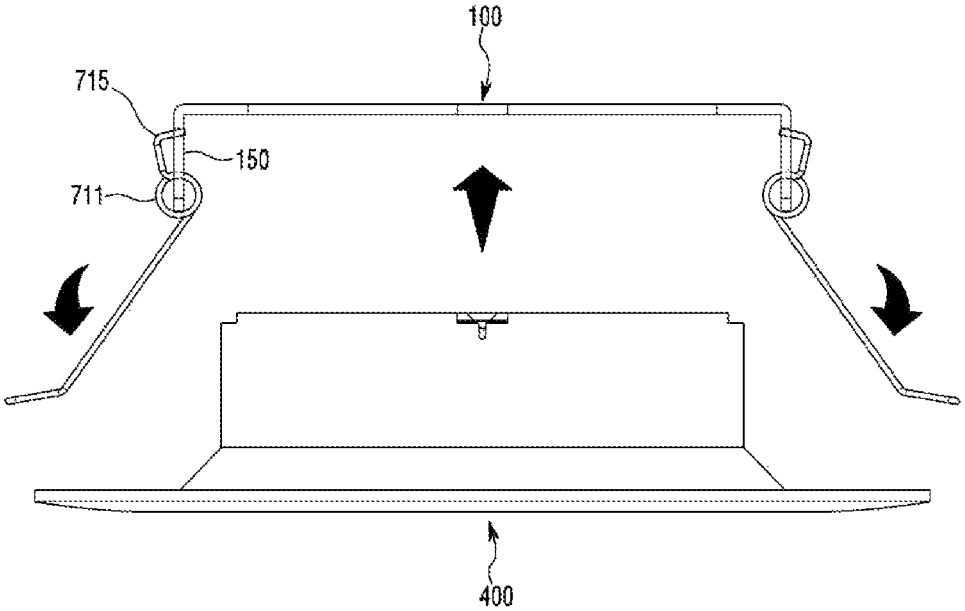
FIG. 21 is a side view showing that the cover part of the lighting device shown in FIG. 20 is separated from the body.

Referring to FIGS. 19 and 21, when the cover part 100 is separated from the body 400, the first spiral portion 711 of the elastic member 700 rotates about the first axis part 151-1 of the coupling portion 150. However, the other end 715 of the elastic member 700 is hung on the first hole 153-1 of the coupling portion 150 of the cover part 100. Accordingly, the other end 715 of the elastic member 700 is not separated from the first hole 153-1 of the coupling portion 150 of the cover part 100.

Figure 22:
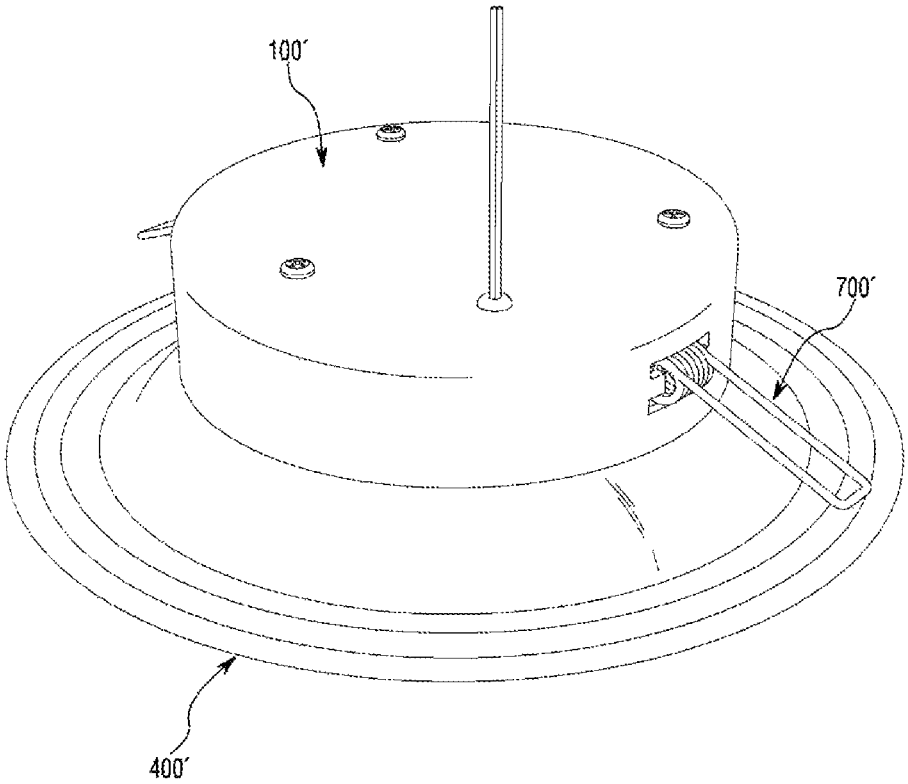
FIG. 22 is a top perspective view of a lighting device according to a second embodiment.
Figure 23:
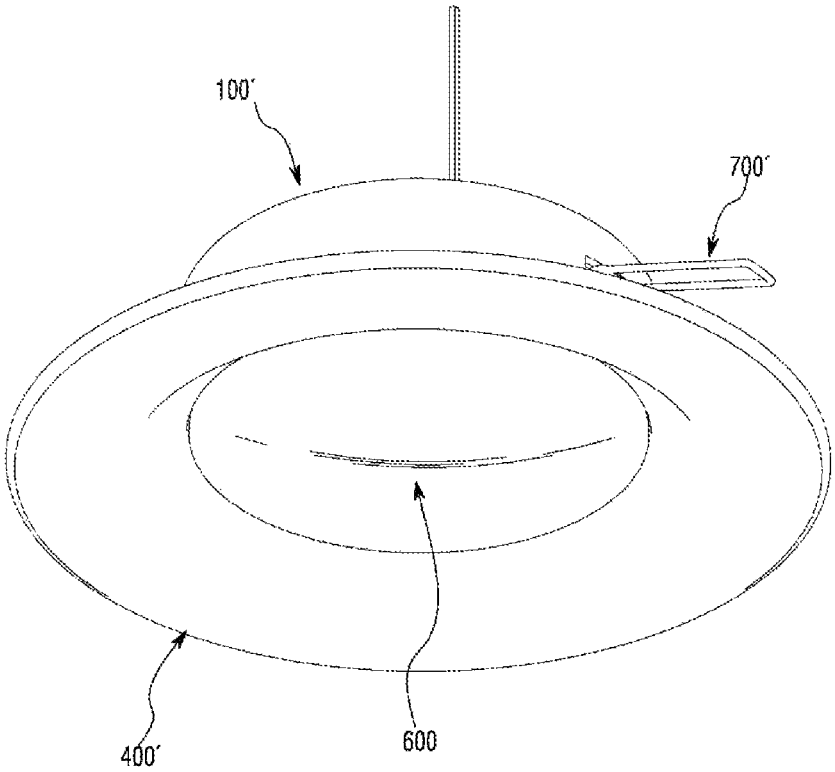
FIG. 23 is a bottom perspective view of the lighting device shown in FIG. 22.
Figure 24:
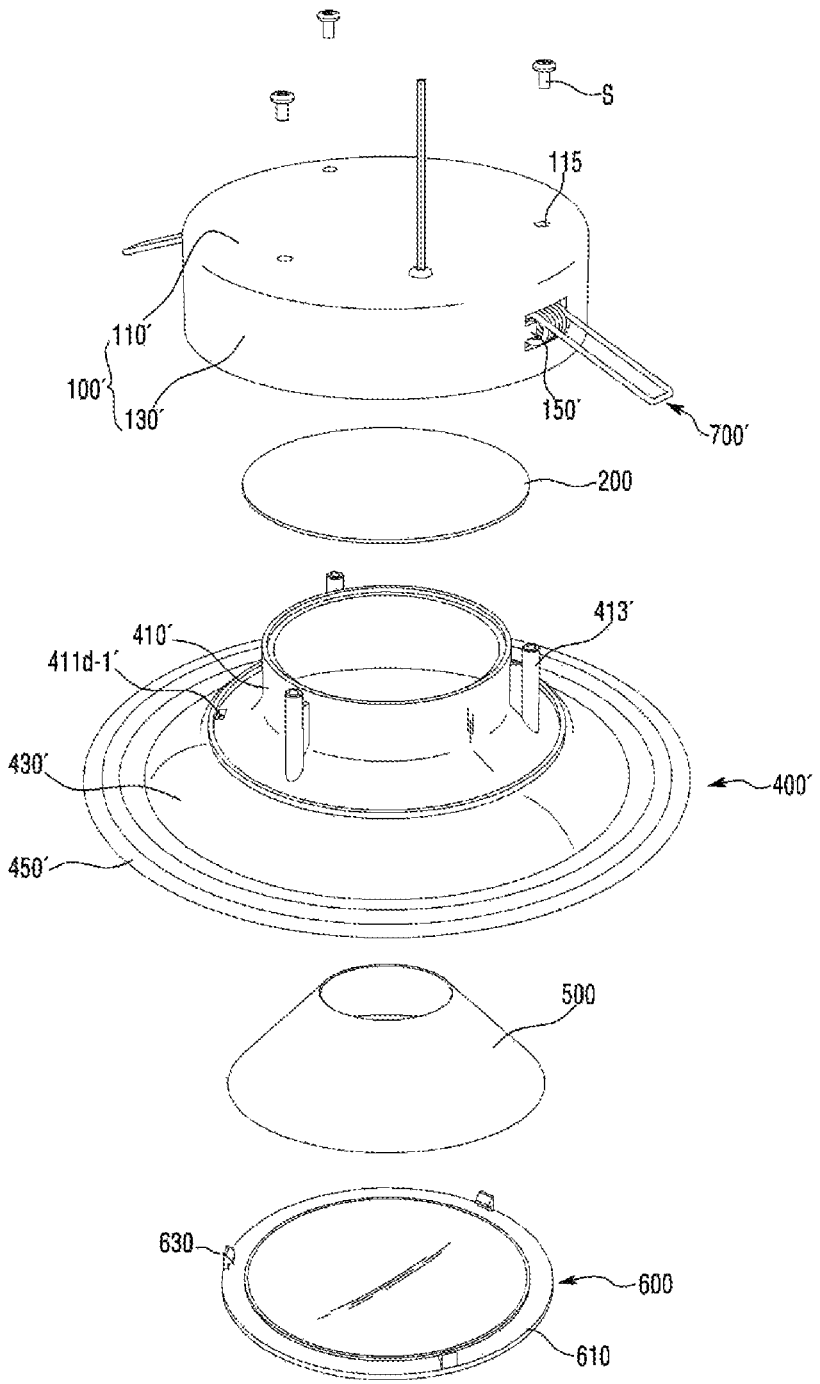
FIG. 24 is an exploded perspective view of the lighting device shown in FIG. 22.
Figure 25:
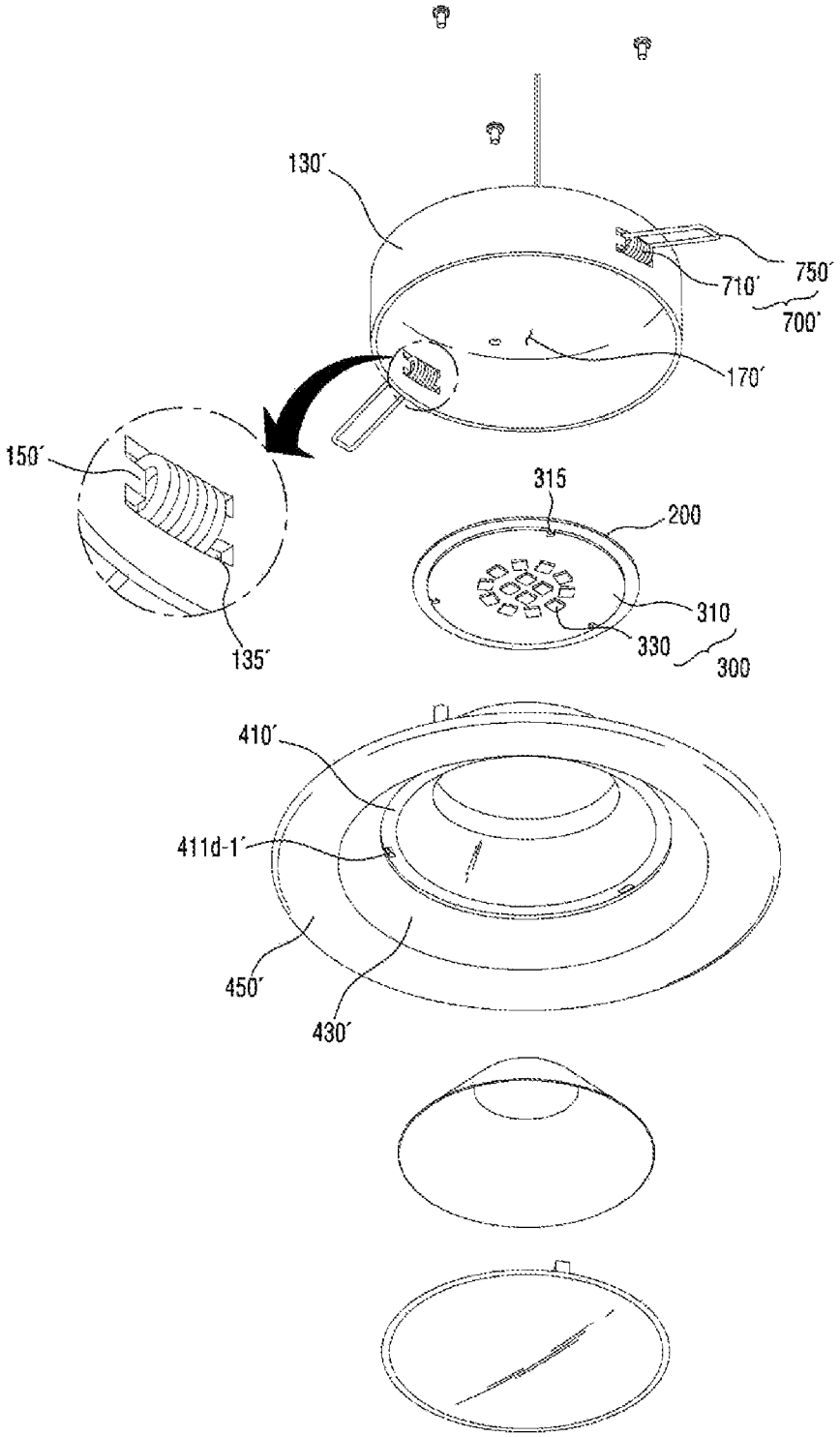
FIG. 25 is an exploded perspective view of the lighting device shown in FIG. 23.

FIG. 22 is a top perspective view of a lighting device according to a second embodiment. FIG. 23 is a bottom perspective view of the lighting device shown in FIG. 22. FIG. 24 is an exploded perspective view of the lighting device shown in FIG. 22. FIG. 25 is an exploded perspective view of the lighting device shown in FIG. 23.

Referring to FIGS. 22 to 25, the lighting device according to the second embodiment may include a cover part 100', a thermally conductive member 200, a light source 300, a body 400', a reflector 500, an optical part 600, and an elastic member 700'. Here, since the thermally conductive member 200, the light source 300, the reflector 500, and the optical part 600 are the same as the thermally conductive member 200, the light source 300, the reflector 500, and the optical part 600 of the lighting device according to the first embodiment shown in FIGS. 1 to 21, the description thereof will be omitted.

The cover part 100' may receive the light source 300 therewithin and may be coupled to the body 400'.

The cover part 100' may include a cover 110', an extension portion 130', and a coupling portion 150'.

The material of the cover part 100' is the same as that of the cover part 100 shown in FIGS. 1 to 6.

The cover 110', the extension portion 130', and the coupling portion 150' may be integrally formed.

The cover 110' may have a plate shape having a top surface, a bottom surface, and an outer circumferential surface connected between the top surface and the bottom surface. The top surface of the cover 110' may be exposed to the outside. The bottom surface of the cover 110' may directly or indirectly contact with the light source 300.

The cover 110' may have a hole 115 through which coupling means S such as a rivet, a screw or the like pass. The hole 115 may pass through the top surface and bottom surface of the cover 110'. The coupling means S is inserted into the hole 115 and then is coupled to a coupling portion 413' of the body 400', so that the cover part 100' and the body 400' may be coupled to each other.

The shape of cover 110' as viewed from the top may be, as shown in the drawings, a circular shape. However, the shape of the cover 110' is not limited to this, and the cover 110' may have an elliptical shape or a polygonal shape.

The extension portion 130' may be formed by extending the outer surface of the cover 110'. Since the area of the cover part 100' is increased by the extension portion 130, the heat radiation efficiency of the lighting device can be more improved. The extension direction of the extension portion 130' may be perpendicular to the top surface or bottom surface of the cover 110'. The extension direction of the extension portion 130' is not limited to this.

The extension portion 130' may have a cylindrical shape. Therefore, the extension portion 130' is coupled to the cover 110', thereby having a space 170' therewithin for receiving the light source 300 and a portion of the body 400'.

The extension portion 130' may have an opening 135'. The coupling portion 150' and the elastic member 700' may be disposed in the opening 135'. The opening 135' corresponds to the number of the elastic members 700'. At least two openings 135' may be provided.

The coupling portion 150' is coupled to the elastic members 700', so that the elastic members 700' can be stably fixed to the cover part 100'.

The coupling portion 150' may protrude toward the opening 135' from at least one of a plurality of sides defining the opening 135'.

One coupling portion 150' may be provided. Also, as shown in the drawings, the coupling portions 150' may extend from two mutually facing sides of the plurality of sides defining the opening 135' and may be disposed opposite to each other.

Since the area of the cover part 100' is increased by the coupling portions 150', the heat radiation efficiency of the lighting device can be more improved. Also, since the elastic member 700' is coupled to the cover part 100' made of a metallic material instead of the plastic-made body 400', the durability and reliability of the lighting device according to the second embodiment can be more obtained.

The body 400' may be coupled to the cover part 100', the light source 300, and the optical part 600 and may be receive the reflector 500 therewithin.

Unlike the metallic cover part 100', the body 400' may be made of plastic. For example, the body 400' may be made of polycarbonate (PC). The plastic-made body 400' is lighter than when the body 400' is made of a metallic material. Also, the manufacturing cost thereof can be reduced.

The body 400' may include a first body 410', a second body 430', and a third body 450'. Here, the first body 410', second body 430', and third body 450' may be integrally formed. However, there is no limit to this. The first body 410', second body 430', and third body 450' may be separately manufactured and coupled to each other.

The first body 410' may be disposed below the light source 300 and may be coupled to the cover part 100' and the light source 300.

The first body 410' may be coupled to the cover 110' of the cover part 100' by coupling means S such as a rivet or a screw. The coupling means S passes through the hole 115 of the cover 110' and is inserted into the coupling portion 413' of the first body 410', so that the first body 410' and the cover 110' can be coupled to each other.

The first body 410' may have a cylindrical shape and a single-wall structure.

The first body 410' may be disposed within the space 170' in the cover part 100'.

The first body 410' may support a substrate 310 of the light source 300. For example, the upper portion of the first body 410' may support an edge portion of the substrate 310.

The first body 410' may include the coupling portion 413'. The coupling portion 413' may be disposed on the outer surface of the first body 410'.

The coupling portion 413' may be coupled to a recess 315 of the substrate 310. A plurality of the coupling portions 413' may be provided in response to the number of the recesses 315 of the substrate 310.

The coupling portion 413' makes it easier to identify where the substrate 310 and the first body 410' are coupled to each other.

Since the first body 410' supports the substrate 310 and the coupling means S passes through the hole 115 of the cover 110' and is coupled to the coupling portion 413', the lighting device according to the second embodiment sufficiently endures a high voltage. Specifically, in a conventional lighting device, the substrate of the light source is directly coupled to a heat sink by means of coupling means such as a screw, etc. As described above, when the substrate is directly coupled to the heat sink by means of a screw, a short-circuit occurs by applying a high voltage to the conventional lighting device, so that the light source is damaged. However, in the lighting device according to the second embodiment, the first body 410' supports the substrate 310, and the substrate 310 is fixed by the coupling of the cover part 100' and the first body 410'. Therefore, there is no requirement for a separate coupling means for fixing the substrate 310 to the cover 110. Accordingly, the lighting device according to the second embodiment does not cause the short-circuit even when a high voltage is applied.

The first body 410' may include a coupling hole 411*d*-1'. The coupling hole 411*d*-1' may be coupled to a connecting portion 630 of the optical part 600.

The second body 430' may be disposed below the first body 410' and may extend from the first body 410'. The second body 430' may diffuse or scatter the light emitted from the optical part 600.

The third body 450' may be disposed below the second body 430' and may extend from the second body 430'.

The elastic member 700' is coupled to the cover part 100'. The elastic member 700' may be coupled to the coupling portion 150' of the cover part 100'.

The elastic member 700' presses the top surface of the ceiling on which the lighting device according to the second embodiment is installed. That is, the ceiling is disposed between the elastic member 700' and the third body 450' of the body 400'. Since an elastic force of the elastic member 700' acts on the third body 450', the lighting device according to the second embodiment can be strongly fixed to the ceiling.

The elastic member 700' may include a spiral portion 710' and a fixing portion 750'.

The spiral portion 710' may be formed by rolling up one wire in a spiral direction.

The spiral portion 710' may be hung on and coupled to the coupling portion 150' of the cover part 100'. The spiral portion 710' may rotate about the coupling portion 150' of the cover part 100'.

The fixing portion 750' may be formed by extending both ends of the spiral portion 710' and by connecting them.

The fixing portion 750' presses the top surface of the ceiling on which the lighting device according to the second embodiment is installed, so that the lighting device according to the second embodiment can be fixed to the ceiling.

The fixing portion 750' may have a U-shape. However, the shape of the fixing portion 750' is not limited to this. The fixing portion 750' has any shape capable of pressing the ceiling.

Although the embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

The invention claimed is:

1. A lighting device comprising:

a light source which comprises a substrate comprising a top surface and a bottom surface, a plurality of light emitting devices disposed in a central portion of the bottom surface of the substrate, and an input/output portion disposed in an edge portion of the bottom surface of the substrate and electrically connected to a wire;

a body which is coupled to the substrate of the light source and comprises an opening through which light from the plurality of light emitting devices of the light source passes; and a reflector disposed below the substrate of the light source and in the opening of the body, wherein the body comprises an inner surface which defines the opening, wherein the body comprises a cover portion which protrudes from the inner surface of the body toward an outer surface of the reflector and covers the input/output portion of the light source and the wire, wherein the cover portion comprises a first support having a first support surface which supports the reflector, wherein the body further comprises a second support spaced apart from the cover portion in a circumferential direction of the inner surface, the second support protruding from the inner surface of the body toward the outer surface of the reflector and contacting the edge portion of the substrate and supporting the reflector, and wherein the second support comprises a second support surface.

2. The lighting device of claim 1, wherein the first support surface of the first support has a shape corresponding to the shape of the reflector.

3. The lighting device of claim 2, wherein the reflector comprises an inner surface which reflects the light from the plurality of light emitting devices, and an outer surface which is disposed on the cover portion, wherein the outer surface of the reflector is curved, and wherein the first support surface of the first support is curved.

4. The lighting device of claim 1, wherein the second support surface of the second support has the same inclined angle as that of the first support surface of the cover portion with respect to the bottom surface of the substrate.

5. The lighting device of claim 1, wherein the body comprises an inner wall having the cover portion and an outer wall surrounding the inner wall.

6. The lighting device of claim 5, wherein the body further comprises an auxiliary wall connected between the inner wall and the outer wall.

7. The lighting device of claim 5, wherein thicknesses of the inner wall of the body and the outer wall of the body are 1 to 2 T respectively.

8. The lighting device of claim 5, wherein the outer wall of the body has a guide groove in which the wire is disposed.

9. The lighting device of claim 1, further comprising a cover disposed on the light source, the cover having at least one hole, wherein the body comprises a coupling portion which corresponds to the hole of the cover, further comprising a coupling means which is inserted into the hole of the cover and is coupled to the coupling portion of the body, wherein the body comprises a guide which protrude toward the opening from the inner surface, and wherein the guide of the body supports the bottom surface of the substrate, and the inner surface of the body guides an outer circumferential surface of the substrate.

10. The lighting device of claim 1, further comprising a cover disposed on the top surface of the substrate, an extension portion extending from the cover in a first direction, and a coupling portion extending from the extension portion in a second direction; and an elastic member which is coupled to the coupling portion of the cover, wherein the body receives the light source and is coupled to the cover.

11. The lighting device of claim 10, wherein the coupling portion of the cover comprises a first hole, a second hole, a first axis part, and a second axis part, wherein the elastic member comprises a first torsion spring, a second torsion spring, and a fixing portion connected to the first torsion spring and the second torsion spring, wherein the first torsion spring comprises a first spiral portion hung on the first axis part of the coupling portion, one end connected to the fixing portion, and the other end which is coupled to the first hole of the coupling portion, and wherein the second torsion spring comprises a second spiral portion hung on the second axis part of the coupling portion, one end connected to the fixing portion, and the other end which is coupled to the second hole of the coupling portion.

12. The lighting device of claim 11, wherein the other end of the first torsion spring comprises a first part which is supported by an outer surface of the coupling portion, and a second part which is inserted into the first hole, wherein an end of the second part passes through the first hole and is disposed adjacent to the body.

13. The lighting device of claim 10, wherein the first direction of the extension portion is perpendicular to the second direction of the coupling portion.

14. A lighting device comprising:

a light source which comprises a substrate comprising a top surface and a bottom surface, and comprises a plurality of light emitting devices disposed on the bottom surface of the substrate; and a body comprising an inner surface which is coupled to the substrate and defines an opening through which light from the plurality of light emitting devices passes, and a guide which extends toward the opening from the inner surface, wherein the guide of the body is disposed below an edge portion of the substrate of the light source and comprises a top surface contacting with the bottom surface of the substrate, wherein the guide of the body comprises a first protrusion and a second protrusion which protrude upward from the top surface of the guide, wherein the first protrusion is disposed closer to an axis extending perpendicular to the substrate and through a center of the substrate than the second protrusion, and wherein the edge portion of the substrate has a recess which is coupled to at least any one of the first protrusion and the second protrusion.

15. The lighting device of claim 14, wherein a height of the second protrusion is greater than a height of the first protrusion.

16. The lighting device of claim 14, wherein heights of the first protrusion and the second protrusion are the same as each other, and wherein the recess of the substrate has a shape capable of receiving both the first protrusion and the second protrusion.

17. A lighting device comprising:

a light source which comprises a substrate comprising a top surface and a bottom surface, and comprises a plurality of light emitting devices disposed on the bottom surface of the substrate; and a body comprising an inner surface which defines an opening through which light from the plurality of light emitting devices passes, and a guide which extends toward the opening from the inner surface of the body, wherein the guide of the body is disposed below a top surface of the body and comprises a top surface contacting with the bottom surface of the substrate, wherein a first protrusion and a second protrusion protrude upward from the top surface of the guide, wherein the first protrusion is disposed closer to an axis extending perpendicular to the substrate and extending through a center of the substrate than the second protrusion, and wherein the edge portion of the substrate has a recess which is coupled to at least one of the first protrusion and the second protrusion.

18. The lighting device of claim 17, wherein the top surface of the guide comprises a level difference surface disposed between a first surface and a second surface, and wherein, when the edge portion of the substrate is disposed on the first surface, the level difference surface guides the substrate.

19. The lighting device of claim 17, wherein, when the edge portion of the substrate is disposed on the second surface, the inner surface of the body guides the substrate.

* * * * *